US010897097B2

(12) United States Patent
Hirakawa

(10) Patent No.: US 10,897,097 B2
(45) Date of Patent: Jan. 19, 2021

(54) ELECTRICAL CONNECTOR DEVICE

(71) Applicant: DAI-ICHI SEIKO CO., LTD., Kyoto (JP)

(72) Inventor: Takeshi Hirakawa, Tokyo (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 16/626,190

(22) PCT Filed: Aug. 29, 2018

(86) PCT No.: PCT/JP2018/031863
§ 371 (c)(1),
(2) Date: Dec. 23, 2019

(87) PCT Pub. No.: WO2019/087551
PCT Pub. Date: May 9, 2019

(65) Prior Publication Data

US 2020/0220287 A1 Jul. 9, 2020

(30) Foreign Application Priority Data

Nov. 6, 2017 (JP) ..... 2017-214126

(51) Int. Cl.
*H01R 12/71* (2011.01)
*H01R 13/115* (2006.01)
*H01R 13/6581* (2011.01)

(52) U.S. Cl.
CPC ..... *H01R 12/71* (2013.01); *H01R 13/115* (2013.01); *H01R 13/6581* (2013.01)

(58) Field of Classification Search
CPC ..... H01R 13/6587; H01R 13/648; H01R 13/6582; H01R 13/6594; H01R 12/52;
(Continued)

(56) References Cited

U.S. PATENT DOCUMENTS 6,923,659 B2 * 8/2005 Zhang ..... H01R 12/716 439/74
7,052,320 B2 * 5/2006 Zhang ..... H01R 13/6582 439/607.36

(Continued)

FOREIGN PATENT DOCUMENTS

CN 104241972 A 12/2014
CN 205882212 U 1/2017

(Continued)

OTHER PUBLICATIONS

International Search Report dated Nov. 20, 2018 in PCT/JP2018/031863 filed on Aug. 29, 2018, 1 page.

(Continued)

*Primary Examiner* — Briggitte R. Hammond
(74) *Attorney, Agent, or Firm* — Oblon, McClelland, Maier & Neustadt, LLP.

(57) ABSTRACT

For miniaturization in a connector width direction in a configuration in which a shield shell is arranged at a position outside a contact member, a configuration is adopted in which when a ground connection section protrudes outward in the connector width direction from a first shield shell arranged outside the connector width direction of a first contact member in a first connector, an inner end surface of the ground connection section at the time of fitting between both the connectors is arranged within a range of a plate width of a second shield shell, to arrange the first shield shell inside the connector width direction of the ground connection section and arrange a second shield shell arranged outside the connector width direction of the first shield shell more inside the connector than a conventional example at the time of fitting both the connectors.

8 Claims, 26 Drawing Sheets

(58) Field of Classification Search
CPC ..... H01R 12/57; H01R 12/71; H01R 13/115; H01R 13/6581
See application file for complete search history.

(56) References Cited

U.S. PATENT DOCUMENTS 7,074,085 B2 * 7/2006 Chen ..... H01R 13/658 439/607.36
7,195,495 B2 * 3/2007 Takano ..... H01R 12/716 439/660
7,585,185 B2 * 9/2009 Obikane ..... H01R 12/52 439/607.01
8,105,112 B2 * 1/2012 Midorikawa ..... H01R 12/716 439/607.35
8,840,407 B2 * 9/2014 Nose ..... H01R 12/716 439/74
9,331,429 B2 * 5/2016 Choi ..... H01R 13/6335
9,755,372 B2 * 9/2017 Ozeki ..... H01R 43/205
9,893,480 B2 * 2/2018 Kodaira ..... H01R 24/60
10,084,265 B2 * 9/2018 Ozeki ..... H01R 12/716
10,498,058 B1 * 12/2019 Kitazawa ..... H01R 13/11
2005/0037642 A1 * 2/2005 Zhang ..... H01R 43/0256 439/74
2005/0282418 A1 * 12/2005 Fan ..... H01R 13/5213 439/148
2011/0250800 A1 * 10/2011 Guo ..... H01R 12/716 439/660
2013/0323971 A1 * 12/2013 Kimura ..... H01R 12/71 439/607.22
2015/0132985 A1 * 5/2015 Choi ..... H01R 13/6275 439/345
2017/0033510 A1 2/2017 Ozeki
2018/0175561 A1 * 6/2018 Chen ..... H01R 12/52

FOREIGN PATENT DOCUMENTS

JP 6117415 B1 4/2017
JP 6145529 B2 6/2017
JP 6179564 B2 8/2017
TW M539713 U 4/2017

OTHER PUBLICATIONS

Office Action dated Jul. 30, 2020, issued in corresponding Chinese patent Application No. 201880043893.4.

* cited by examiner

ELECTRICAL CONNECTOR DEVICE

TECHNICAL FIELD

The present invention relates to an electrical connector device.

BACKGROUND ART

Generally, in various types of electrical equipment, an electrical connector device for substrate connection referred to as a stacking connector has been widely adopted. In the electrical connector device for substrate connection, a structure has been adopted in which a second connector (plug connector) to which a second wiring substrate is connected is arranged to oppose a first connector (receptacle connection) to which a first wiring substrate is connected above the first connector, and the second connector on the upper side is pushed to be lowered toward the first connector on the lower side from such an upper and lower opposing state so that both the electrical connectors are brought into a fitted state, to electrically connect both the first and second wiring substrates.

In the electrical connector device for substrate connection, a so-called EMI (electro magnetic interference) countermeasure has been requested to be taken with a recent higher frequency of a transmission signal. For example, in Japanese Patent Application No. 6117415, described below, a shield shell for electromagnetic shielding is arranged outside a contact member for signal transmission in a connector width direction.

In this case, spacing for avoiding generation of a spark or a short circuit due to a solder material needs to be provided in the connector width direction between a signal conductive path to which a contact member for signal transmission is connected and a ground conductive path to which a substrate connection section in a shield shell is connected in a wiring substrate. Accordingly, the entire electrical connector device increases in size in the connector width direction. Particularly, the electrical connector device according to Japanese Patent Application No. 6117415, described below, has a structure in which the substrate connection section in the shield shell is bent inward in the connector width direction, and thus has a structure in which the shield shell stretches to a position outside in the connector width direction of the ground conductive path to which the substrate connection section in the shield shell is connected. Accordingly, the entire electrical connector device does not easily decrease in size in the connector width direction.

On the other hand, in recent years, as the transmission signal has been multipolarized, the electrical connector device tends to be lengthened in the connector width direction. The shield shell provided in the electrical connector device having such a longitudinal shape is structured to extend in an elongated shape so that deflection and deformation easily occur. Therefore, an expected shield function and impedance characteristic may not be obtained.

PRIOR ART DOCUMENTS

Patent Documents

Patent Literature 1: Japanese Patent No. 6117415

DISCLOSURE OF INVENTION

Problem to be Solved by the Invention

In view of these circumstances, an object of the present invention lies in providing an electrical connector device for substrate connection that can easily achieve miniaturization in a connector width direction in a structure in which a shield shell is arranged at a position outside in the connector width direction of a contact member.

Means for Solving Problem

In order to achieve the above object, in the invention according to claim 1, in an electrical connector device for substrate connection including a first connector and a second connector that are brought into a fitted state with they being respectively mounted on main surfaces of first and second wiring substrates, in which first and second contact members composed of a conductive member for signal connection and first and second shield shells with conductivity having a predetermined plate width in a connector width direction at a position outside in the connector width direction of the first and second contact members are respectively attached to first and second housings having an insulating property provided in the first and second connectors, in which first and second substrate connection sections provided in the first and second shield shells are electrically connected to first and second conductive paths for grounding provided in the first and second wiring substrates, and in which an outer end surface in the connector width direction of the first shield shell and an inner end surface in the connector width direction of the second shield shell are in an overlapping relationship by opposing each other in the connector width direction when the first connector and the second connector are fitted into each other, a configuration is adopted in which the first substrate connection section protrudes outward in the connector width direction from the outer end surface of the first shield shell, and an inner end surface in the connector width direction of the first substrate connection section is arranged within a range of the plate width of the second shield shell in the connector width direction when the first connector and the second connector are fitted into each other.

According to the invention according to claim 1 having such a configuration, since the first shield shell is arranged inside in the connector width direction of the first substrate connection section, the second shield shell arranged outside the first shield shell is arranged more inside the connector than in the conventional example when both the connectors are fitted into each other, so that the entire electrical connector device is miniaturized in the connector width direction while ensuring a distance in the connector width direction between the first substrate connection section in the first shield shell and a signal connection section in the first contact member.

Also, like the invention according to claim 2, it is desired that the first substrate connection section include a step section stretching outward in the connector width direction from the outer end surface of the first shield shell, and a connection piece section protruding toward the main surface of the first wiring substrate from the step section.

According to the invention according to claim 2 having such a configuration, the entire first shield shell is maintained in a state separated from the main surface of the first wiring substrate by an amount in which the connection piece section in the first substrate connection section protrudes toward the main surface of the first wiring substrate, and accordingly the first shield shell does not easily interfere with a conductive path for signal transmission in the first contact member arranged inside the first shield shell. As a result, the first shield shell can be brought closer to the conductive path for signal transmission, and, by bringing the conductive path for grounding to be connected with the first substrate connection section in the first shield shell closer in the connector width direction to the conductive path for signal transmission to be connected with the first contact member, further miniaturization can be achieved.

Further, like the invention according to claim 3, the first substrate connection section can be separated outward in the connector width direction from an outer end surface in the connector width direction of the first housing.

Further, like the invention according to claim 4, it is desired that the first housing include a gap section that separates the outer end surface in the connector width direction inward in the connector width direction from the first shield shell in a site opposing the first contact member in the connector width direction.

According to the invention according to claim 4 having such a configuration, a connected state of the first contact member, or the like, can be observed via the gap section, and simultaneously, by adjusting the size of the gap section, an impedance characteristic can be adjusted to a favorable state.

Also, like the invention according to claim 5, a plurality of the first and second contact members are arranged with predetermined spacing in a connector longitudinal direction perpendicular to the connector width direction, and the first connection section can be arranged between the adjacent first contact members in the connector longitudinal direction.

Further, like the invention according to claim 6, the first and second contact members are electrically connected to first and second conductive paths for signal transmission provided in the first and second wiring substrates, and at least apart of the first and second conductive paths for signal transmission can be arranged in a state where they oppose the first and second conductive paths for grounding in the connector width direction.

Further, like the invention according to claim 7, the first shield shell can be provided with a leaf spring piece elastically contacting the second shield shell when the first connector and the second connector are fitted into each other.

On the other hand, in the invention according to claim 8, the first shield shell in the invention according to claim 1 extends in the connector longitudinal direction, and it is desired that an engagement piece fixed to a part of the first housing be provided in a portion between both ends in an extension direction of the first shield shell.

According to the invention according to claim 8 having such a configuration, the first shield shell is firmly fixed to the first housing via the engagement piece so that the first shield shell becomes unlikely to deform, and accordingly the size of the gap section can be kept constant so that a stable shield function is obtained.

Effect of the Invention

As described above, an electrical connector device for substrate connection according to the present invention can easily achieve miniaturization in a connector width direction in a structure in which a shield shell is arranged at a position outside in the connector width direction of the contact member.

BRIEF DESCRIPTIONS OF THE DRAWINGS

EMBODIMENTS FOR CARRYING OUT THE INVENTION

Figure 1:
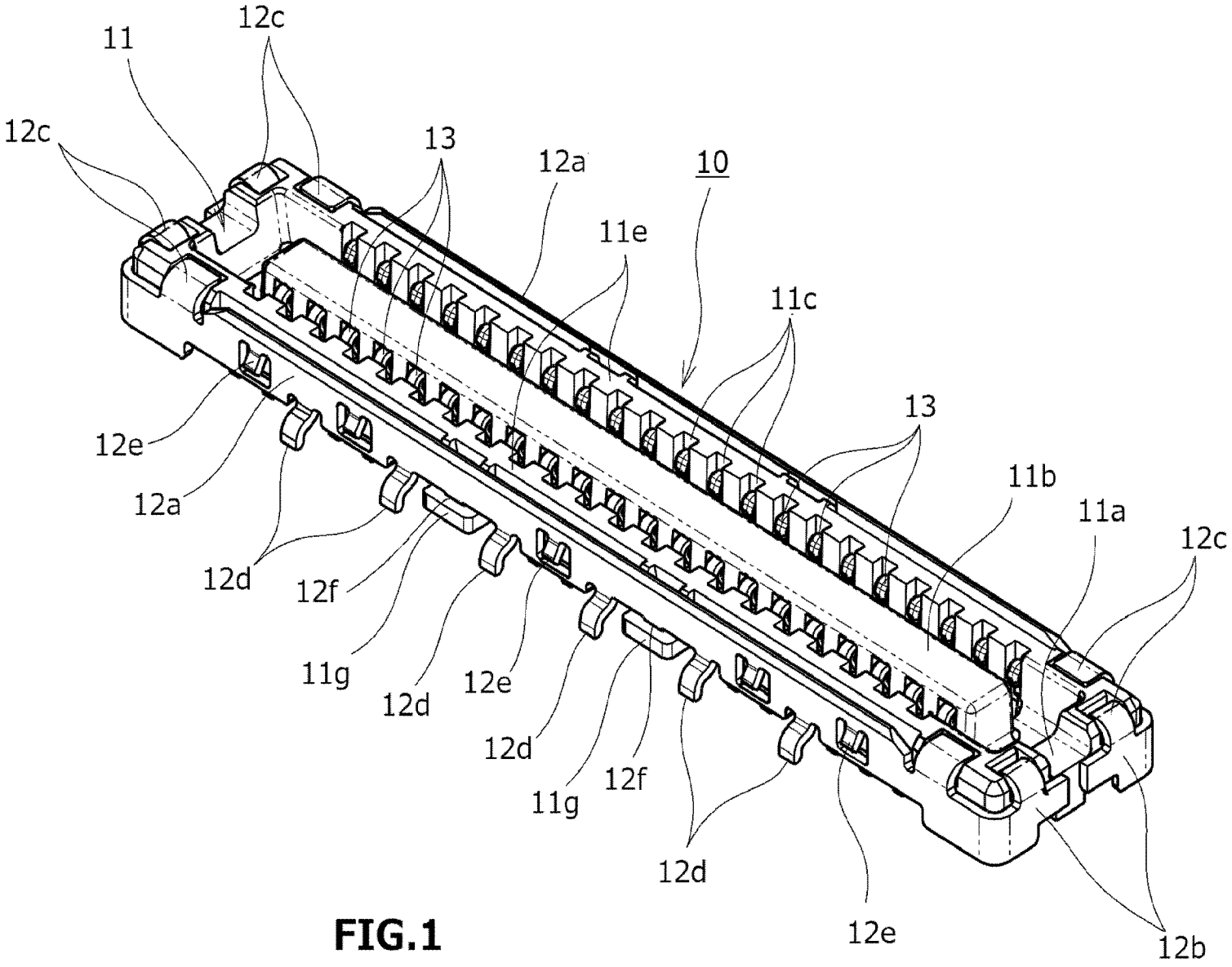
FIG. 1 is an appearance perspective explanatory diagram illustrating a first connector (receptacle connector) according to an embodiment of the present invention from above.
Figure 2:
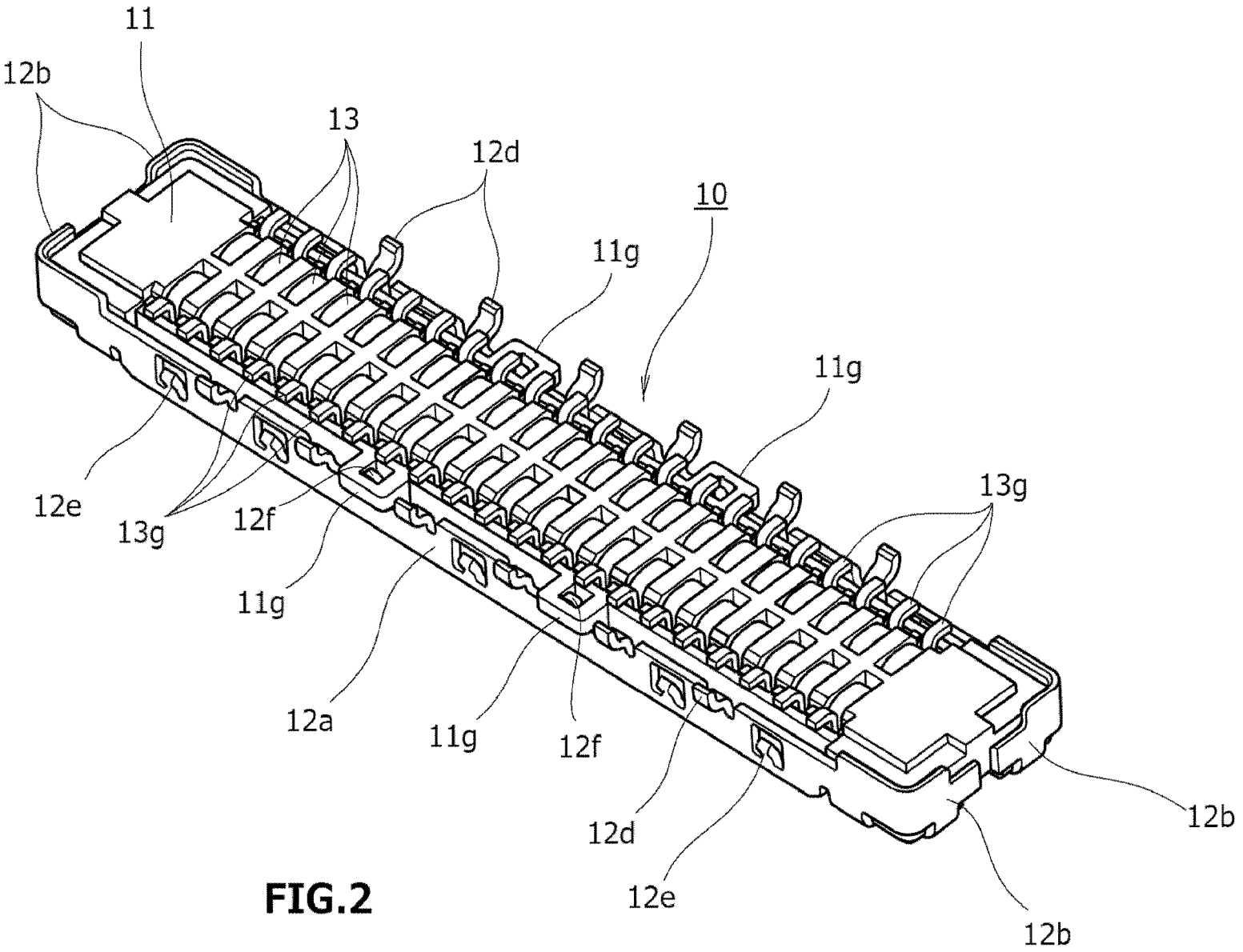
FIG. 2 is an appearance perspective explanatory diagram illustrating a state where the first connector (receptacle connector) according to the embodiment of the present invention illustrated in FIG. 1 is vertically inverted.
Figure 3:
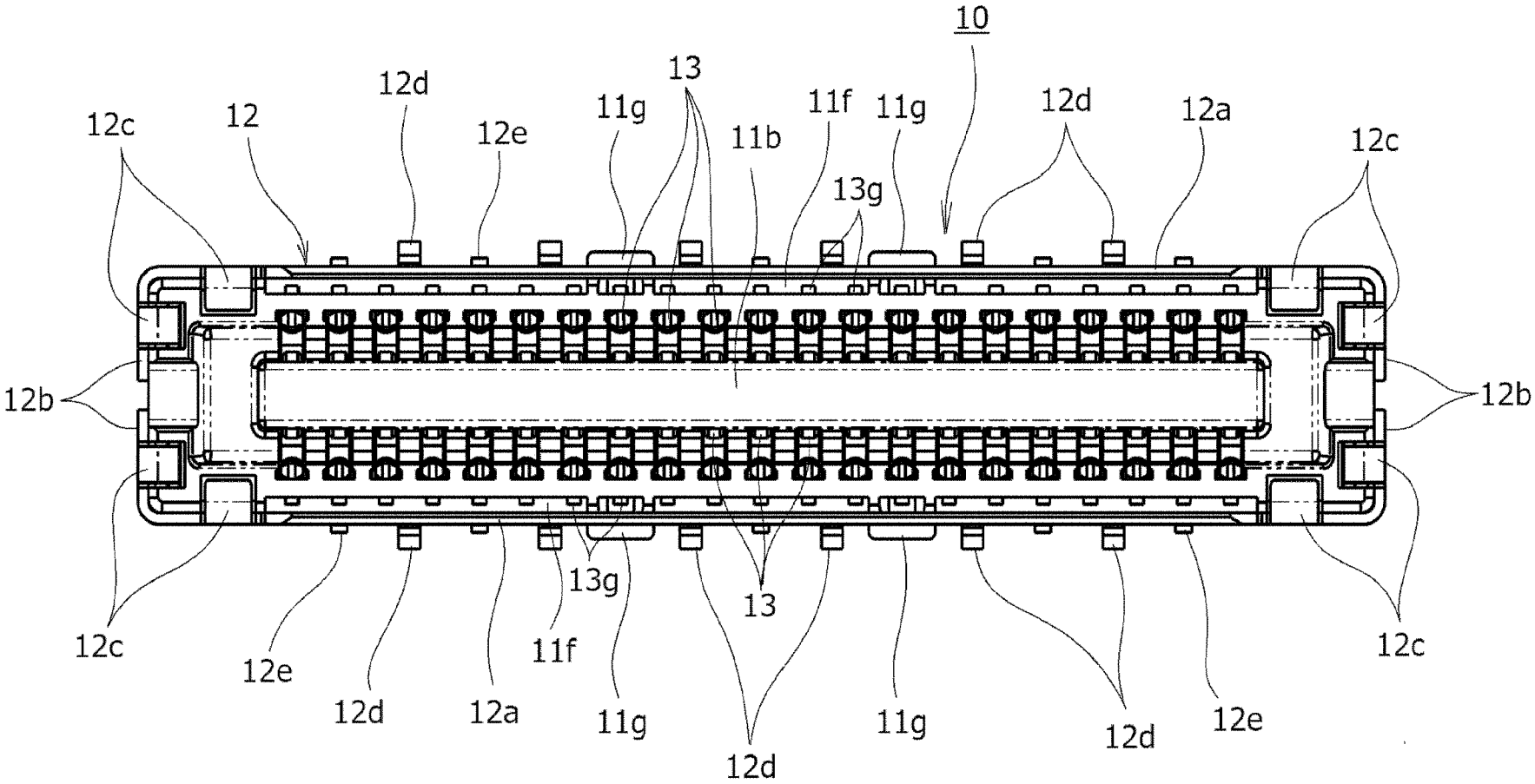
FIG. 3 is a plan explanatory diagram illustrating the first connector (receptacle connector) according to the embodiment of the present invention illustrated in FIG. 1 and FIG. 2.
Figure 4:
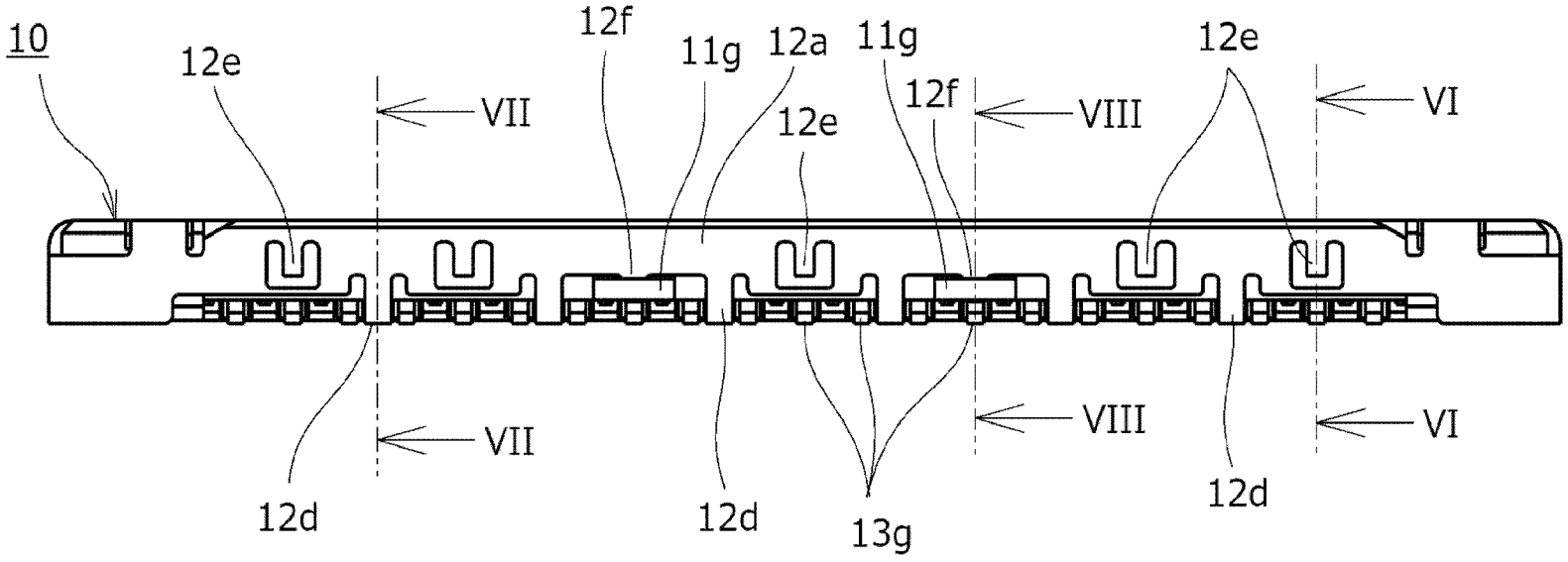
FIG. 4 is a front explanatory diagram illustrating the first connector (receptacle connector) according to the embodiment of the present invention illustrated in FIG. 1 to FIG. 3.
Figure 5:
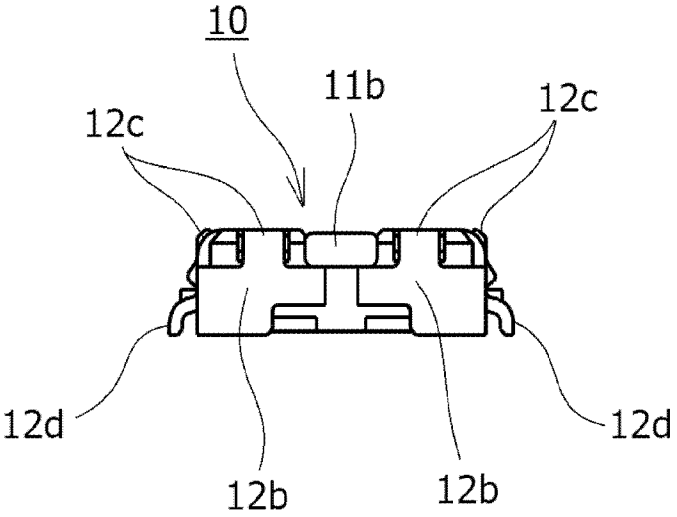
FIG. 5 is a side explanatory diagram illustrating the first connector (receptacle connector) according to the embodiment of the present invention illustrated in FIG. 1 to FIG. 4.

An embodiment to which the present invention is applied will be described below with reference to the drawings.

[As to Entire Structure of Electrical Connector Device]

An electrical connector device for substrate connection according to an embodiment of the present invention illustrated in FIG. 1 to FIG. 24 is used to electrically connect wiring substrates arranged within each of various types of electronic equipment such as a smartphone or a tablet computer, and includes a receptacle connector 10 as a first connector illustrated in FIG. 1 to FIG. 9 and a plug connector 20 as a second connector illustrated in FIG. 10 to FIG. 17. When the receptacle connector (first connector) 10 is mounted by solder bonding or the like on a main surface of a first wiring substrate P1 illustrated in FIG. 25, for example, while the plug connector (second connector) 20 is mounted by solder bonding or the like on a main surface of a second wiring substrate P2 illustrated in FIG. 26, for example. A fitting operation is performed after both the electrical connectors 10 and 20, which have been each brought into a mounted state, are arranged such that the respective main surfaces of the wiring substrates oppose each other so that the above-described first and second wiring substrates P1 and P2 are electrically connected to each other via both the electrical connectors 10 and 20.

In the following description, a fitting direction of the receptacle connector (first connector) 10 and the plug connector (second connector) 20 is referred to as an "up-and-down direction". When the plug connector 20 is pushed downward, for example, from a state where both the electrical connectors 10 and 20 are aligned with each other from an upper and lower facing state where the plug connector 20 is arranged at a position above the receptacle connector 10 arranged at a lower position in the up-and-down direction, both the electrical connectors 10 and 20 are brought into a fitted state, as illustrated in FIG. 18 to FIG. 24.

The plug connector (second connector) 20 is configured to be removed upward from the receptacle connector (first connector) positioned below by being pulled with an appropriate force upward from the above-described fitted state. An operation for fitting and removing the plug connector (second connector) 20 to and from the receptacle connector (first connector) 10 is not necessarily performed with a worker's hand, but can also be automatically performed by using a predetermined jig or machine.

Although the plug connector (second connector) 20 arranged above is arranged to oppose the receptacle connector (first connector) 10 arranged below in a vertically inverted state when both the electrical connectors 10 and 20 are fitted and removed to and from each other, the plug connector 20 alone used in the vertically inverted state is described in a state before the inversion, i.e., in a state where the plug connector 20 is mounted from above on the second wiring substrate P2 arranged below.

The receptacle connector (first connector) 10 and the plug connector (second connector) 20 constituting the electrical connector device for substrate connection respectively include a first housing 11 and a second housing 21 each extending in an elongated shape. Although the first housing 11 and the second housing 21 are molded, for example, using a resin material such as plastic having an insulating property, many first contact members 13 and many second contact members 23 each composed of a conductive member for signal connection are arranged at a predetermined pitch in a longitudinal direction of the first housing 11 and the second housing 21. The longitudinal direction of the first housing 11 and the second housing 21 as an arrangement direction of the first contact members 13 and the second contact members 23 is hereinafter referred to as a "connector longitudinal direction", and a lateral direction perpendicular to the "connector longitudinal direction" and the "up-and-down direction" is hereinafter referred to as a "connector width direction".

Figure 9:
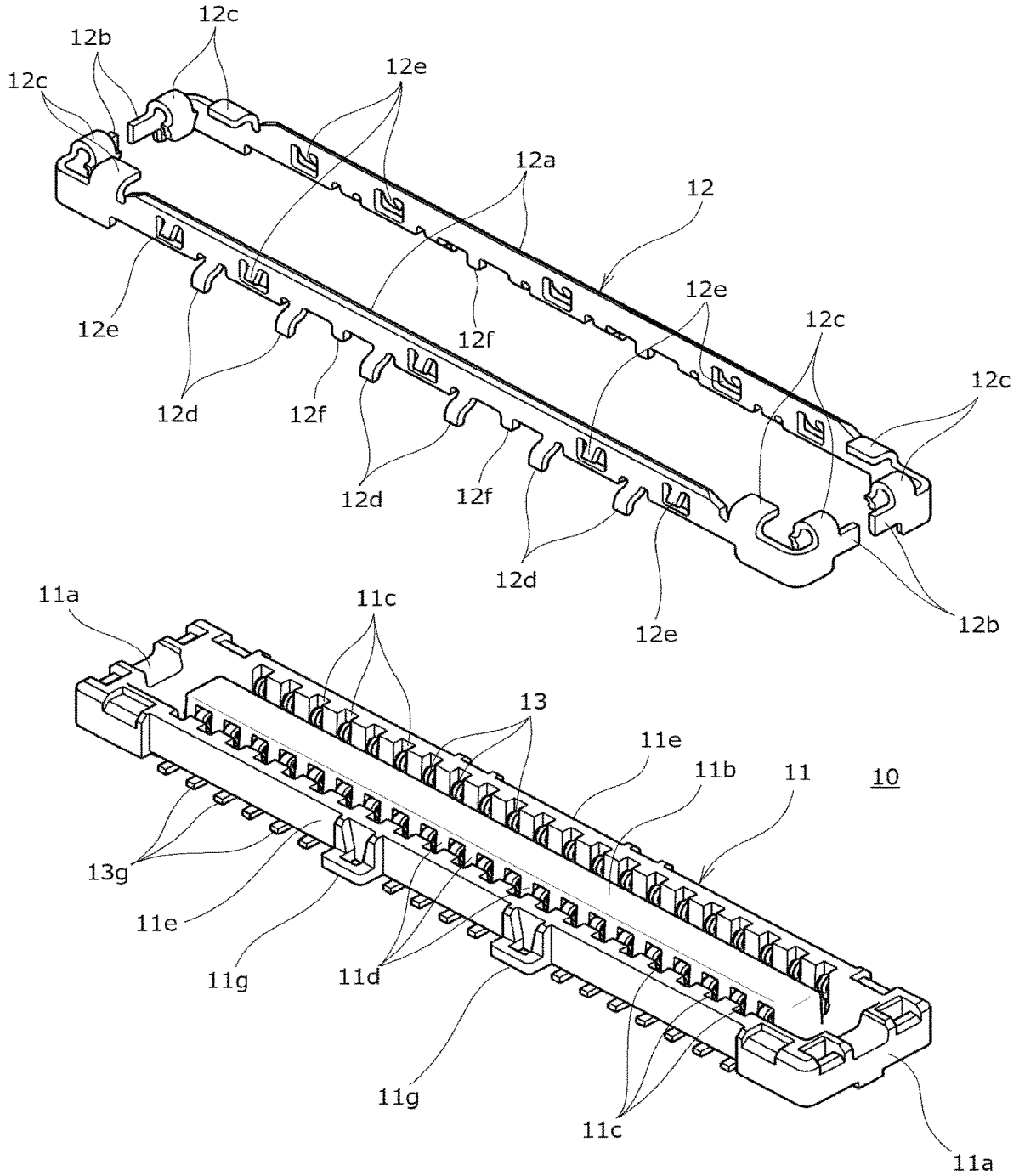
FIG. 9 is an appearance perspective explanatory diagram illustrating a first connector (receptacle connector) according to the embodiment of the present invention illustrated in FIG. 1 to FIG. 8 in an exploded manner.
Figure 10:
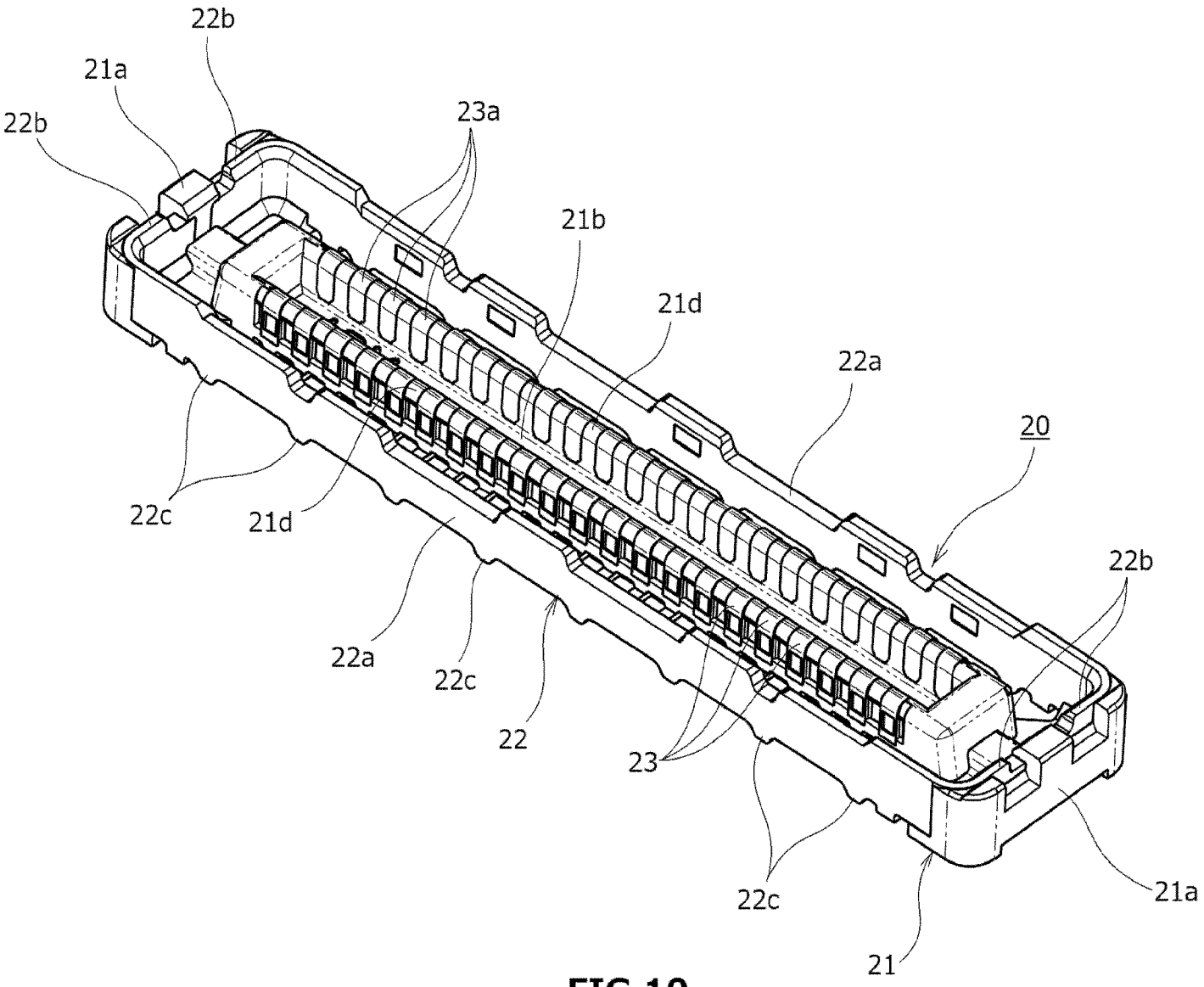
FIG. 10 is an appearance perspective explanatory diagram illustrating a second connector (plug connector) according to the embodiment of the present invention to be fitted into the first connector (receptacle connector) illustrated in FIG. 1 to FIG. 9 from above.
Figure 11:
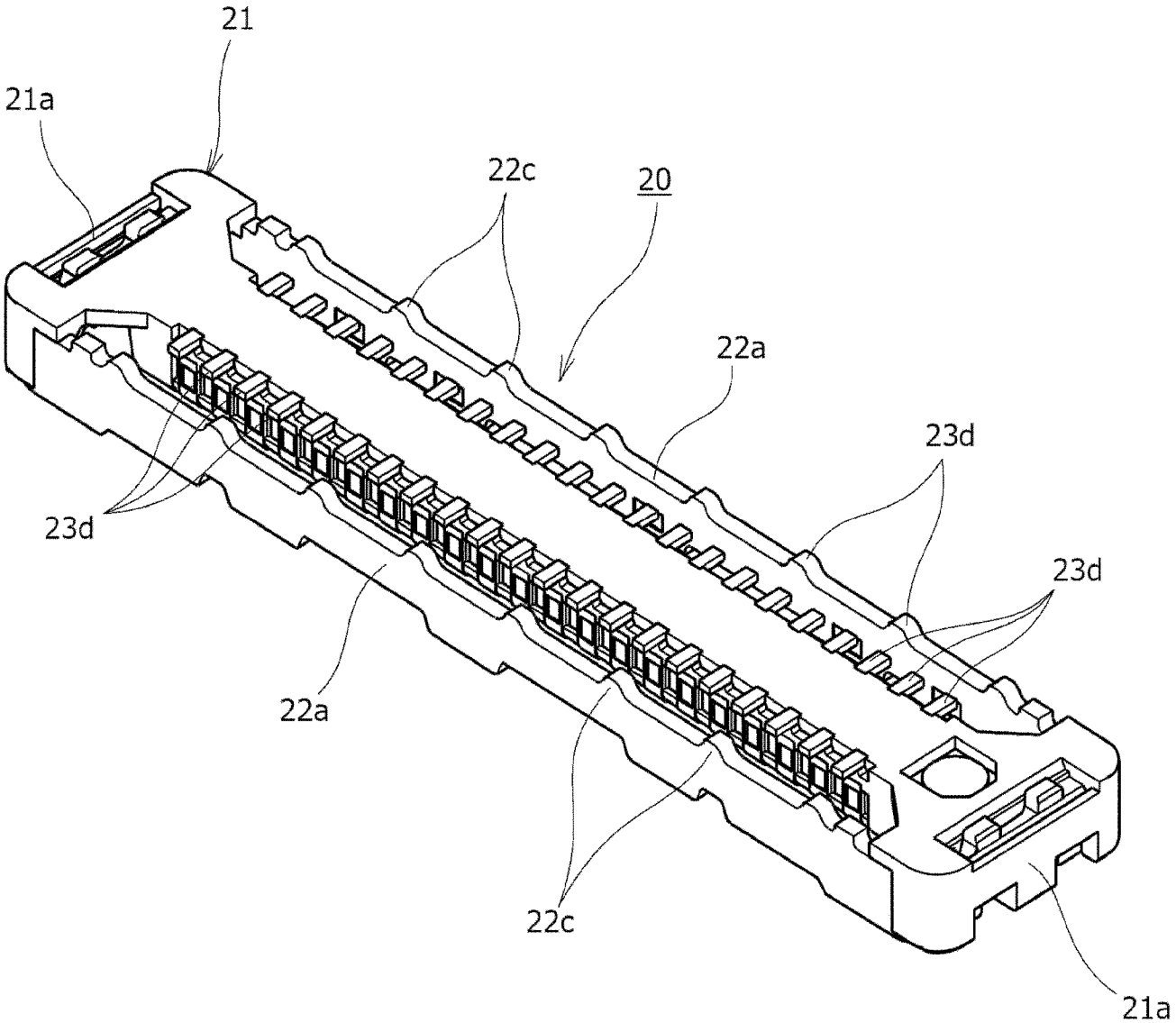
FIG. 11 is an appearance perspective explanatory diagram illustrating a state where the second connector (plug connector) according to the embodiment of the present invention illustrated in FIG. 10 is vertically inverted.
Figure 12:
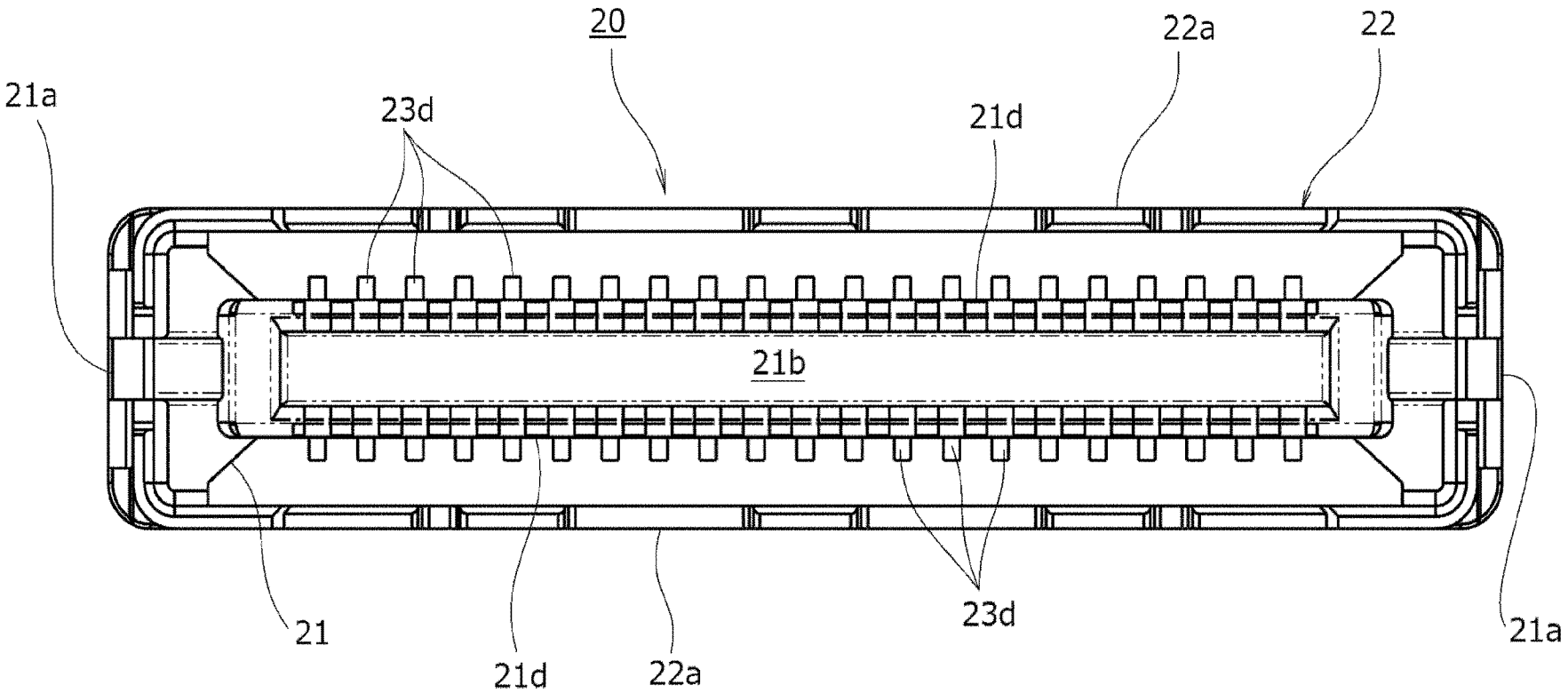
FIG. 12 is a plan explanatory diagram illustrating the second connector (plug connector) according to the embodiment of the present invention illustrated in FIG. 10 and FIG. 11.
Figure 13:
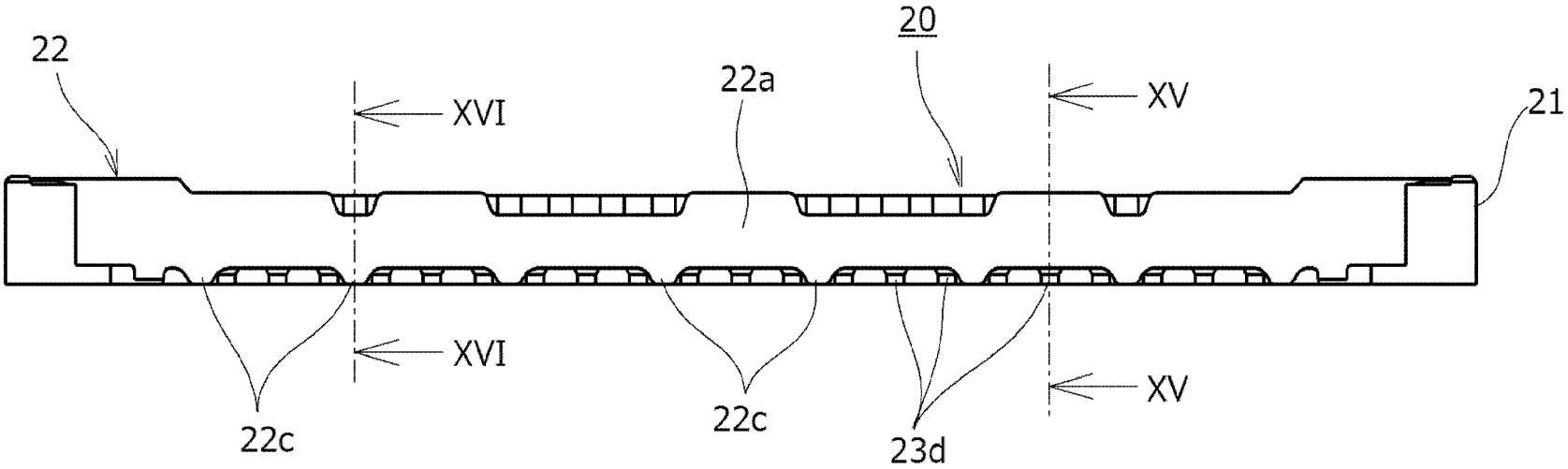
FIG. 13 is a front explanatory diagram illustrating the second connector (plug connector) according to the embodiment of the present invention illustrated in FIG. 10 to FIG. 12.
Figure 14:
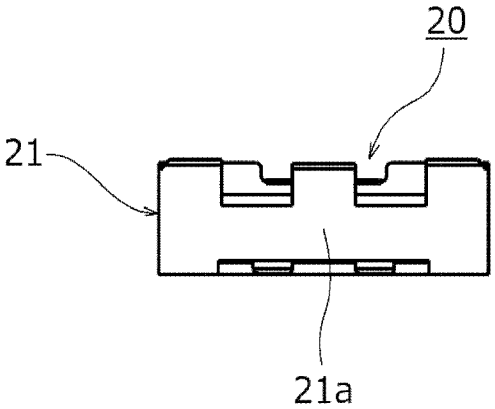
FIG. 14 is a side explanatory diagram illustrating the second connector (plug connector) according to the embodiment of the present invention illustrated in FIG. 10 to FIG. 13.
Figure 17:
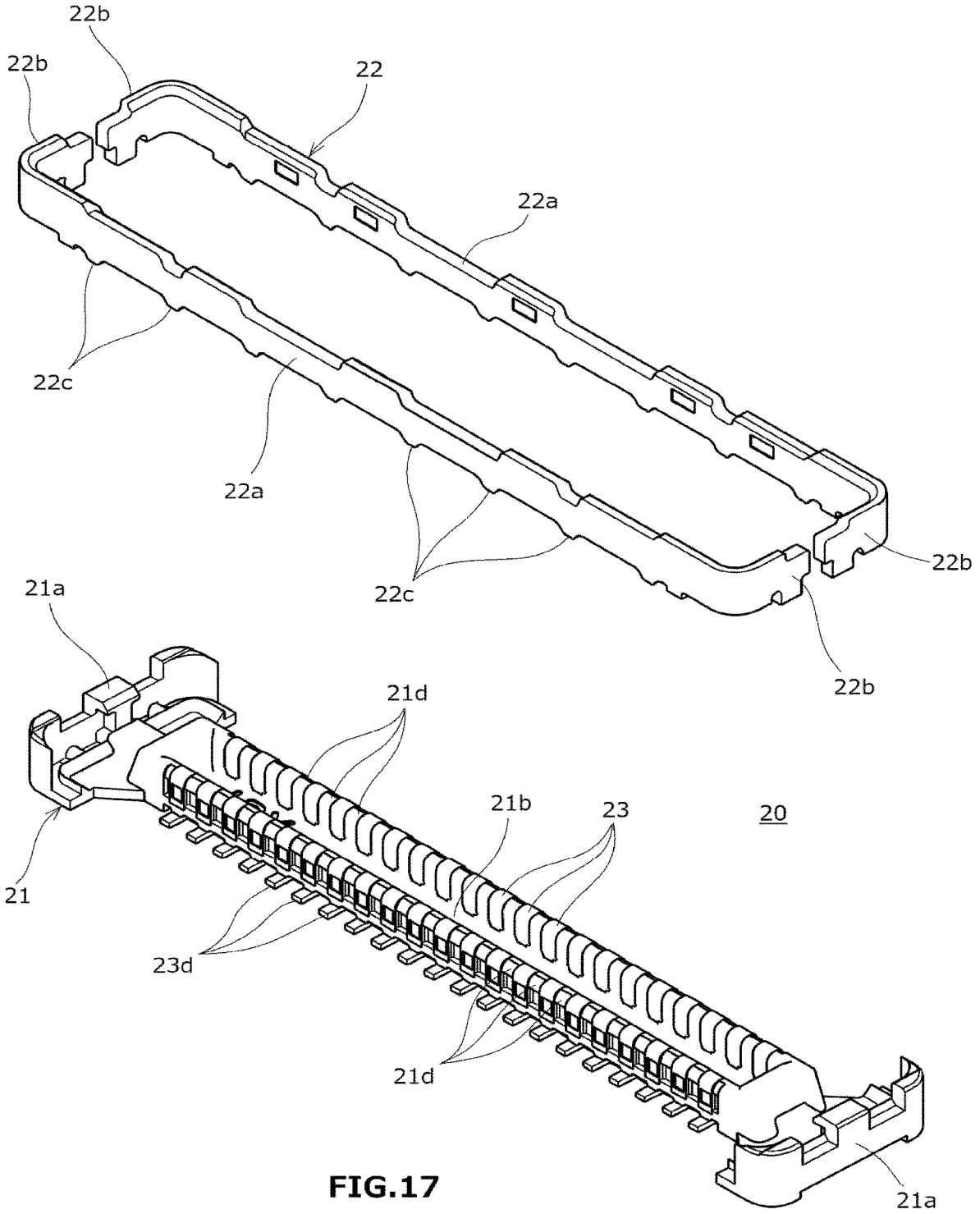
FIG. 17 is an appearance perspective explanatory diagram illustrating the second connector (plug connector) according to the embodiment of the present invention illustrated in FIG. 10 to FIG. 16 in an exploded manner.
Figure 18:
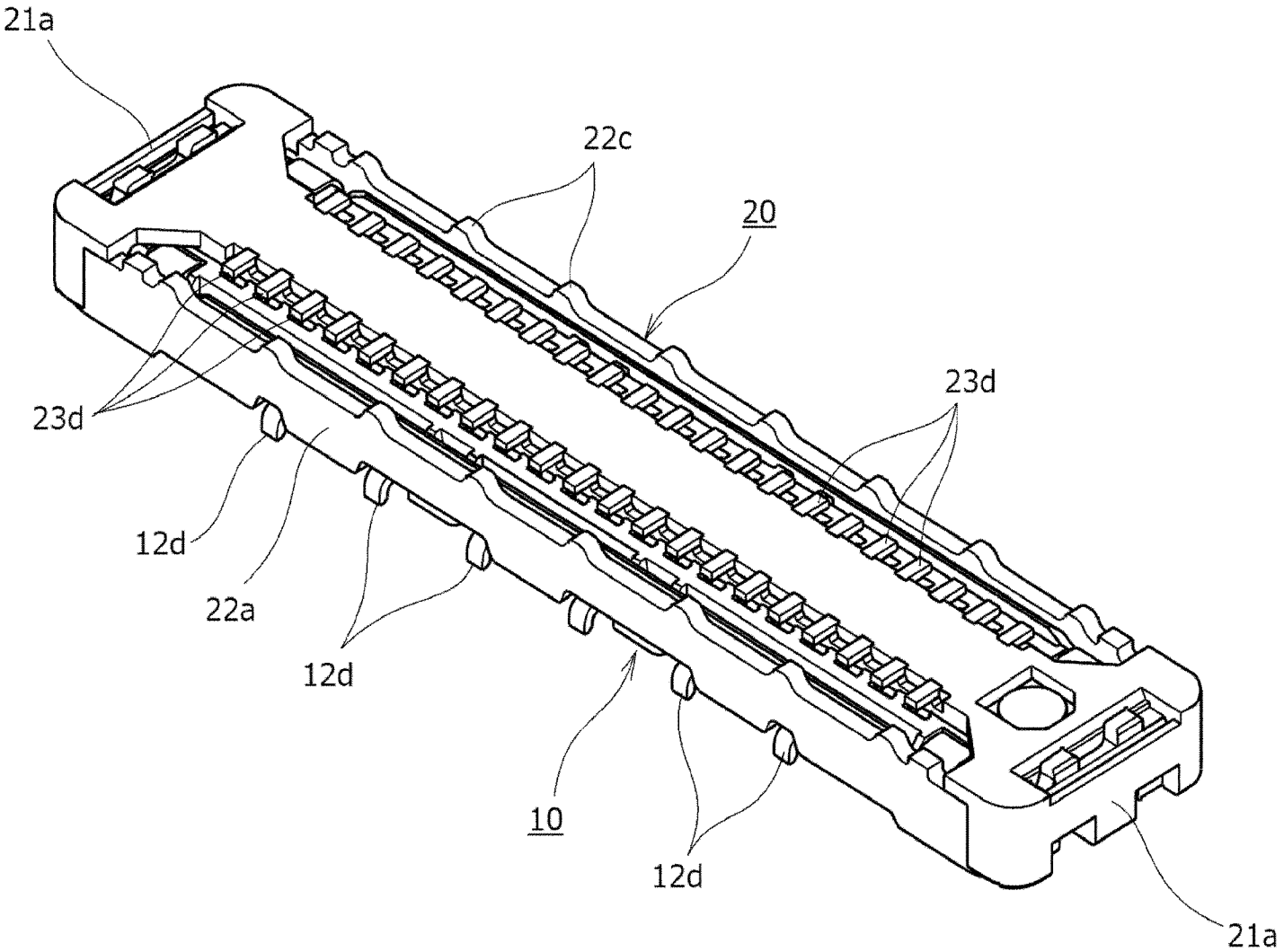
FIG. 18 is an appearance perspective explanatory diagram illustrating a state where the first and second connectors according to the embodiment of the present invention are fitted into each other with the second connector arranged on the upper side from above.
Figure 19:
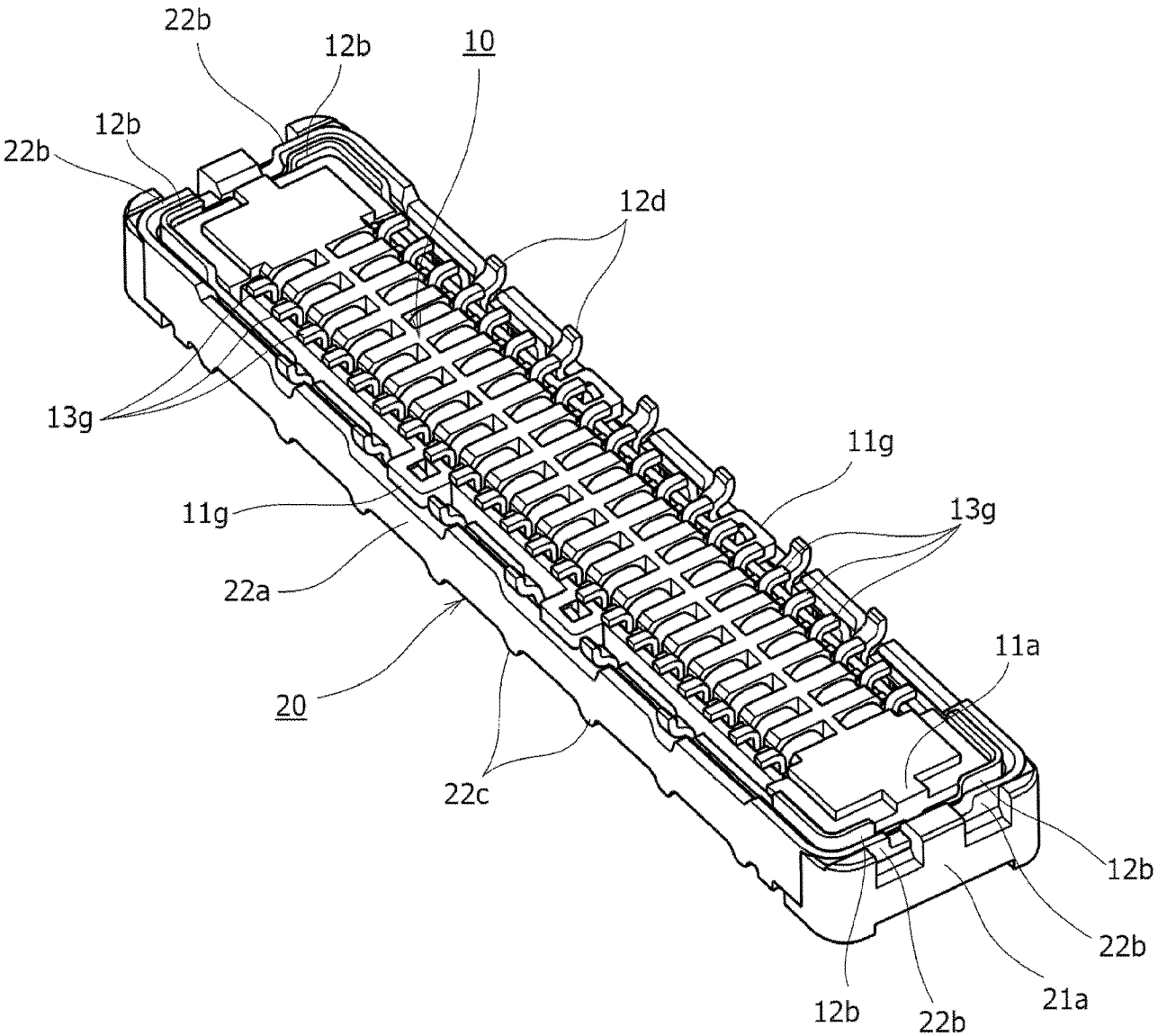
FIG. 19 is an appearance perspective explanatory diagram illustrating a state where a fitted state of the first and second connectors illustrated in FIG. 18 is vertically inverted.
Figure 20:
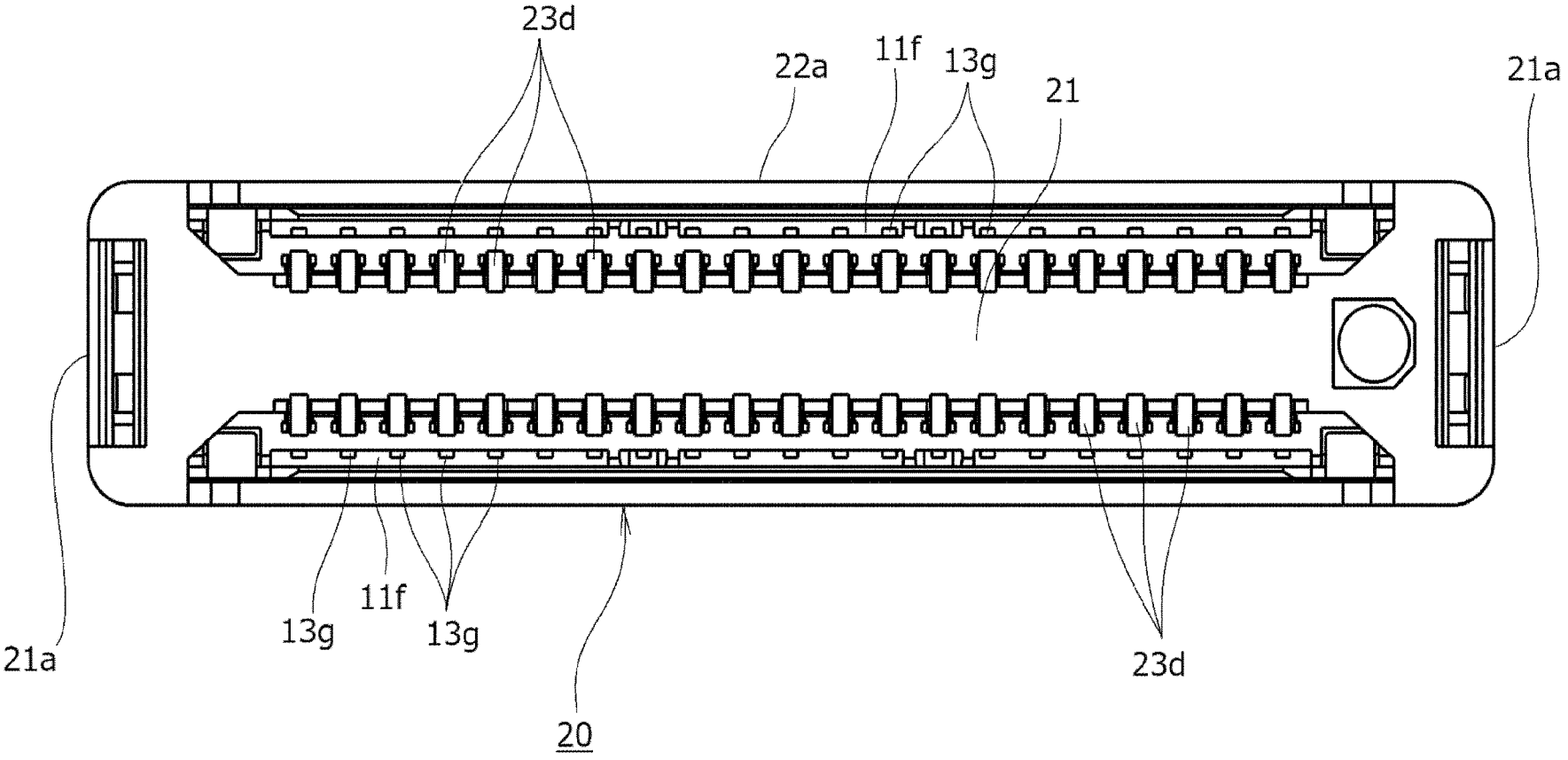
FIG. 20 is a plan explanatory diagram illustrating a state where the first and second connectors illustrated in FIG. 18 and FIG. 19 are fitted into each other.
Figure 21:
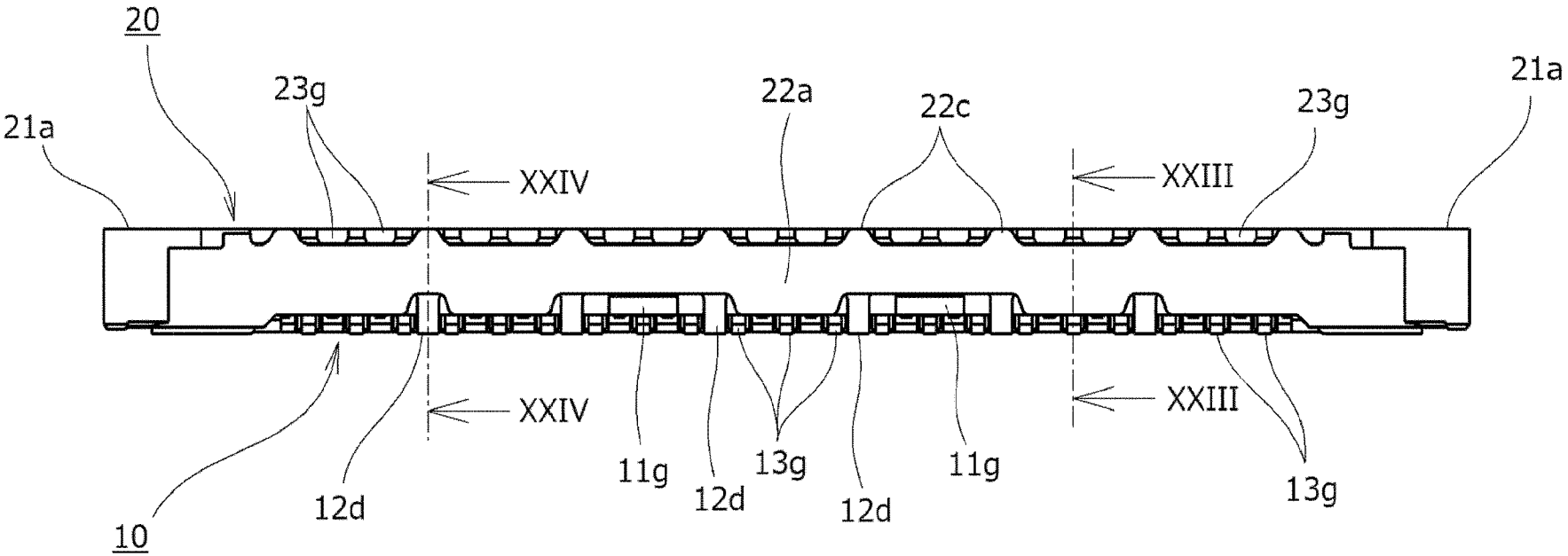
FIG. 21 is a front explanatory diagram illustrating a state where the first and second connectors illustrated in FIG. 18 and FIG. 19 are fitted into each other.
Figure 22:
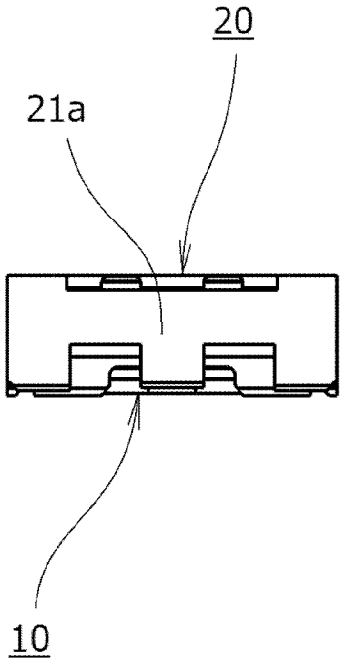
FIG. 22 is a side explanatory diagram illustrating a state where the first and second connectors illustrated in FIG. 18 and FIG. 19 are fitted into each other.
Figure 23:
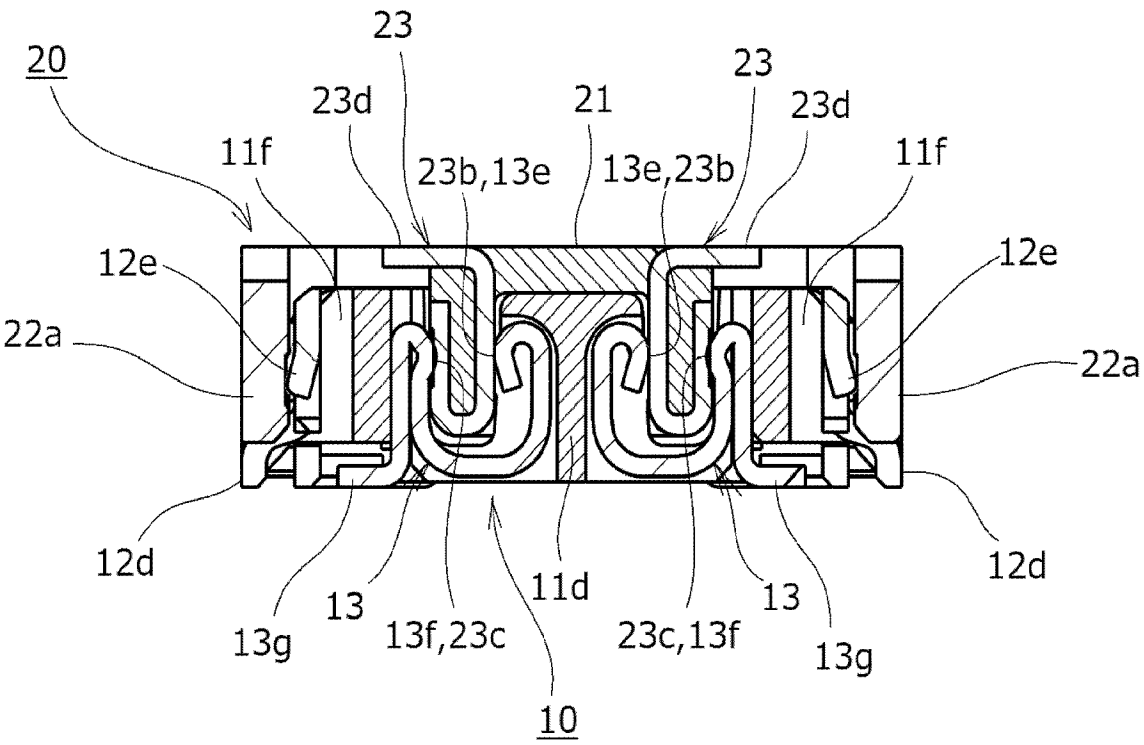
FIG. 23 is an enlarged transverse sectional explanatory diagram also illustrating a wiring substrate along a line XXIII-XXIII in FIG. 21.

The first housing 11 and the second housing 21 respectively include proximal end sections 11*a* and 11*a* and proximal end sections 21*a* and 21*a* in both end portions and both end portions in the longitudinal direction of the first housing 11 and the second housing (the connector longitudinal direction), as particularly illustrated in FIG. 9 and FIG. 17. A central protrusion 11*b* is provided to be integrally hung in the connector longitudinal direction between both central portions in the connector width direction of the proximal end sections 11*a* and 11*a* in the receptacle connector (first connector) 10 while a central recess 21*b* is provided to be integrally hung in the connector longitudinal direction between both central portions in the connector width direction of the proximal end sections 21*a* and 21*a* in the plug connector (second connector) 20. Although the proximal end sections 11*a* and 11*a* in the first housing 11 and the proximal end sections 21*a* and 21*a* in the second housing 21 are each brought into an arrangement relationship in which they oppose each other in the connector longitudinal direction, respectively, via the central protrusion 11*b* and the central recess 21*b*, a first shield shell 12 and a second shield shell 22 are respectively attached to be hung in the connector longitudinal direction between both ends in the connector width direction of the proximal end sections 11*a* and 11*a* and between both ends in the connector width direction of the proximal end sections 21*a* and 21*a*.

The first shield shell 12 and the second shield shell 22 are each formed of a bending structure of a conductive member composed of a thin plate-shaped metal member or the like, and are respectively mounted in arrangement relationships in which outer portions of the first housing 11 and the second housing 21 are surrounded in a planar, substantially rectangular shape to be sandwiched from both sides in the connector longitudinal direction and the connector width direction to constitute shield wall sections for the first contact members 13 and the second contact members 23, described below. The first shield shell 12 mounted on the receptacle connector (first connector) 10 at this time is fixed to the first housing 11 by press fitting from above while the second shield shell 22 mounted on the plug connector (second connector) 20 is fixed to the second housing 21 by press fitting or insert molding from above.

Contact mounting grooves 11*c* each having a concave channel shape are concavely provided to be arranged with predetermined spacing in the connector longitudinal direction in the central protrusion 11*b* in the above-described first housing 11, as illustrated in FIG. 1, while contact mounting grooves (illustration of which is omitted) are also concavely provided to be arranged with predetermined spacing in the connector longitudinal direction and the central recess 21*b* in the second housing 21. The first contact members 13 and the second contact members 23 are respectively attached to the contact mounting grooves 11*c* and the like by press fitting or insert molding. The plurality of first contact members 13 and the plurality of second contact members 23 are arranged with predetermined spacing in the connector longitudinal direction.

Although an entire configuration of the receptacle connector (first connector) 10 and the plug connector (second connector) 20 is schematically described above, a detailed configuration and arrangement relationship of each of sections will be described below.

First, the first contact members 13 attached to the first housing 11 in the receptacle connector (first connector) 10 by press fitting and the second contact members 23 attached to the second housing 21 in the plug connector (second connector) 20 by insert molding are each brought into an arrangement relationship to form two electrode arrays extending substantially parallel to each other in the connector longitudinal direction, respectively, for the electrical connectors 10 and 20. The first contact members 13 and 13 respectively constituting the two electrode arrays and the second contact members 23 and 23 respectively constituting the two electrode arrays are brought into an arrangement relationship in which they symmetrically oppose each other in the connector width direction. In the following description, the first contact members 13 and 13 and the second contact members 23 and 23 brought into a symmetrical arrangement relationship are each described as identical without being distinguished.

[As to Contact Member in Receptacle Connector]

Figure 8:
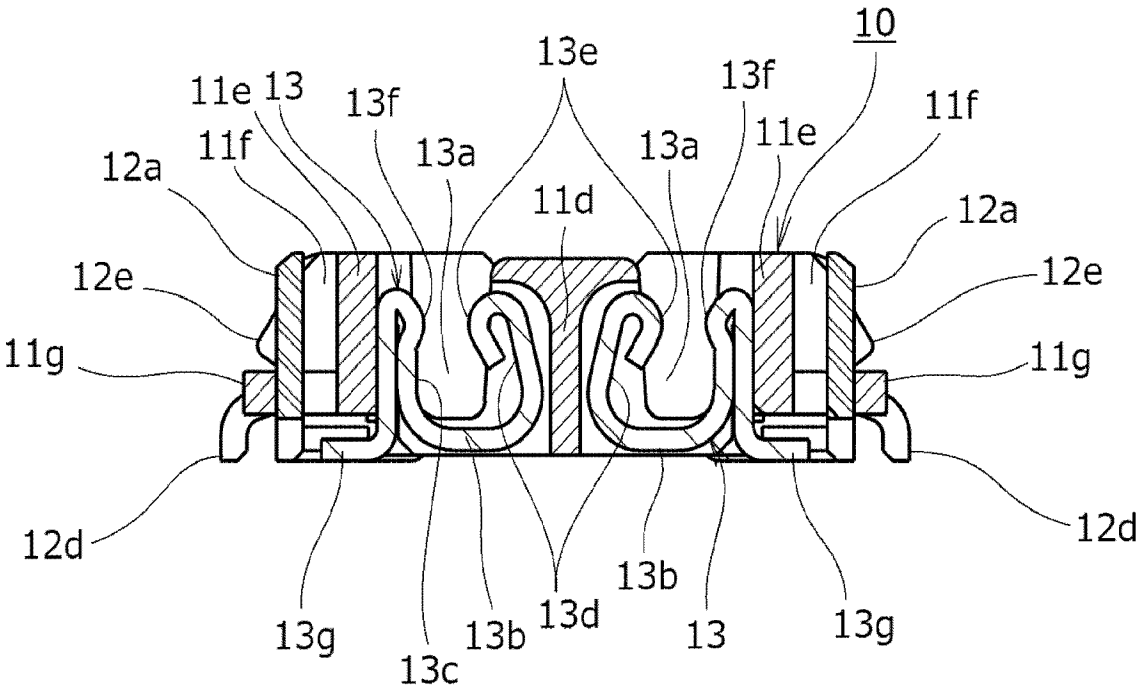
FIG. 8 is an enlarged transverse sectional explanatory diagram along a line VIII-VIII illustrated in FIG. 4.

More specifically, a partition plate 11*d* protruding upward from a bottom plate is first provided to extend in a band plate shape in the connector longitudinal direction in a portion between the above-described two electrode arrays, i.e., a central portion in the connector width direction, as particularly illustrated in FIG. 8, in a central protrusion 11*b* in the first housing 11 to which the first contact member 13 in the receptacle connector (first connector) 10 is attached. Although the partition plate 11*d* constitutes a groove bottom portion in the connector width direction of the above-described contact mounting groove 11*c*, the paired first contact members 13 and 13 respectively constituting the electrode arrays on both sides are arranged in a positional relationship in which they oppose each other to have symmetrical shapes in the connector width direction, respectively, in space portions between the partition plate 11*d* and longitudinal wall sections 11*e* and 11*e* vertically provided on both sides in the connector width direction of the partition plate 11*d*.

Each of the first contact members 13 is formed of a band plate-shaped member made of a metal bent to extend in a curved shape outward from the connector central portion in the connector width direction, and is attached to the above-described contact mounting groove 11*c* by press fitting from below. In the first contact member 13, a fitting recess 13*a* bent and formed to extend in a substantially U shape is formed to be recessed in a concave shape in the connector center portion nearer the above-described partition plate 11*d*, and a part of the second contact member 23 in the plug connector (second connector) 20 as a mating fitting body is inserted from above into an inner space of the fitting recess 13*a*.

That is, the fitting recess 13*a* in the first contact member 13 extending in a substantially U shape, as described above, includes an outward rising side section 13*c* and an inward rising side section 13*d* that rises upward from both sides of a bottom side section 13*b* extending in the connector width direction. The outward rising side section 13*c* arranged outside in the connector width direction out of both the inward and outward rising side sections 13*c* and 13*d* is brought into a fixed state by press fitting from below to the contact mounting groove 11*c* concavely provided in the above-described longitudinal sidewall section 11*a*. The above-described bottom side section 13*b* extends in a cantilevered shape toward a connector center (inward) from the outward rising side section 13*c* brought into the fixed state while the inward rising side section 13*d* extends in the same cantilevered shape via the bottom side section 13*b*. The inward rising side section 13*d* is arranged to come close to the partition plate 11*d* nearer the connector center, and is elastically displaceable in a direction opposing the connector width direction with respect to the outward rising side section 13*c* brought into the fixed state, as described above.

An upper end portion of the inward rising side section 13*d* arranged on the connector center side is bent and formed to stretch in a curved shape toward an inner space of the above-described fitting recess 13*a*, and an inner contact section 13*e* is formed to have a convex shape in a site stretching into the inner space of the fitting recess 13*a* in a bent portion having the curved shape. The inner contact section 13*e* is brought into a relationship electrically connected by contacting a part of the second contact member 23 in the plug connector (second connector) 20 when a part of the second contact member 23 is inserted into the inner space of the fitting recess 13*a*, as described above. This point will be described in detail in a succeeding stage.

The outward rising side section 13*c* arranged on the connector outer side is inserted into the contact mounting groove 11*c* provided in the longitudinal sidewall section 11*a*, as described above, and is formed such that an outer contact section 13*f* has a convex shape in a site facing the inner space of the fitting recess 13*a*. The outer contact section 13*f* is brought into a relationship electrically connected by contacting a part of the second contact member 23 in the plug connector (second connector) 20 when a part of the second contact member 23 is inserted into the inner space of the fitting recess 13*a*, as described above. This point will also be described in detail in the succeeding stage.

Thus, the first contact member 13 in the receptacle connector (first connector) 10 is configured such that the inner contact section 13*e* and the outer contact section 13*f* in two positions are provided for each of the fitting recesses 13*a* in the first contact member 13, and is configured such that signal transmission to the second contact member 23 in the plug connector (second connector) 20 is performed via the inner contact section 13*e* and the outer contact section 13*f* provided for the first contact member 13.

Figure 25:
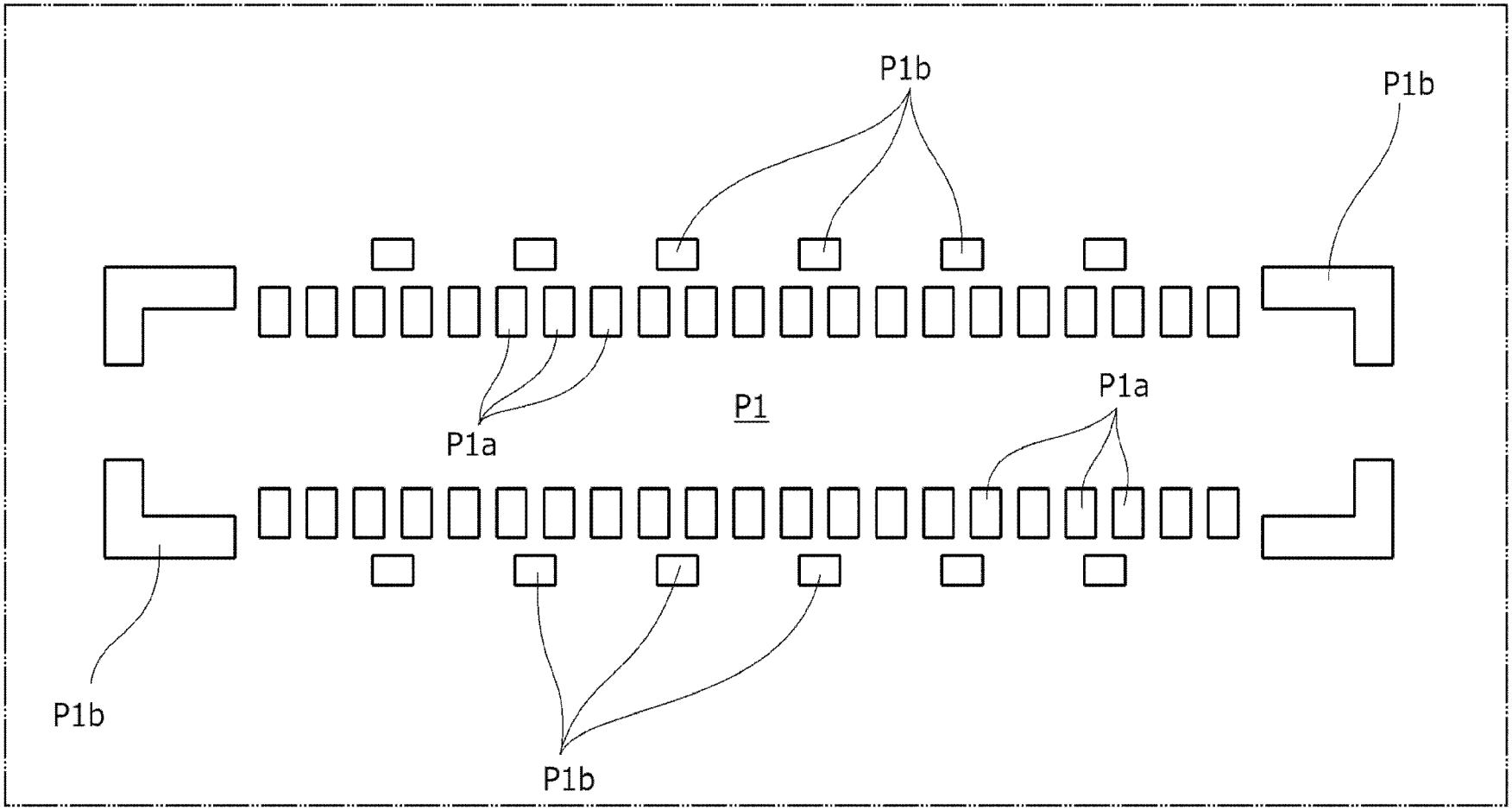
FIG. 25 is an appearance perspective explanatory diagram illustrating an example of a structure of a wiring substrate on which the first connector (receptacle connector) is mounted.

The outward rising side section 13*c* in the first contact member 13 is bent in an inverted U shape to be inverted downward after stretching toward the connector outer side by being raised to an upper surface position of the receptacle connector (first connector) 10 from the above-described bottom surface section 13*b*, and is bent at a substantially right angle toward the connector outer side again at a lower surface position of the receptacle connector 10 to be a first contact connection section (signal connection section) 13*g*. The first contact connection section 13*g* extends substantially horizontally outward in the connector width direction, and is solder-bonded to a conductive path for signal transmission (signal pad) P1*a* on the first wiring substrate P1 as illustrated in FIG. 25 when the receptacle connector 10 is mounted on the first wiring substrate P1. The solder bonding of the first contact connection section 13*g* is integrally performed for all the first contact connection sections 13*g* using a longitudinal solder material.

[As to Contact Member in Plug Connector]

Then, as illustrated in FIG. 17, the central recess 21*b* in the second housing 21 in the plug connector (second connector) 20 includes a pair of longitudinal sidewall sections 21*d* and 21*d* extending substantially parallel to each other in the connector longitudinal direction (the arrangement direction of the second contact 23). A plurality of contact mounting grooves (not illustrated) each having a concave channel shape are arranged with predetermined spacing in the connector longitudinal direction in each of the longitudinal sidewall sections 21*d*, and the second contact members 23 are respectively attached by insert molding to constitute two electrode arrays to the contact mounting grooves. The second contact members 23 respectively constituting the two electrode arrays are brought into an arrangement relationship in which they symmetrically oppose each other in the connector width direction.

Figure 15:
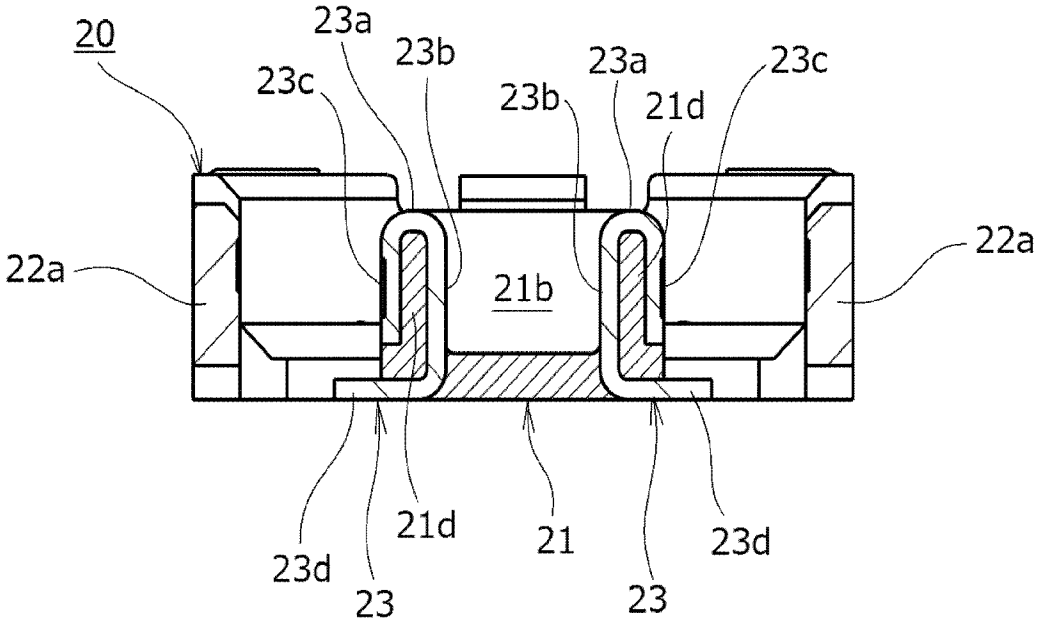
FIG. 15 is an enlarged transverse sectional explanatory diagram along a line XV-XV in FIG. 12.
Figure 16:
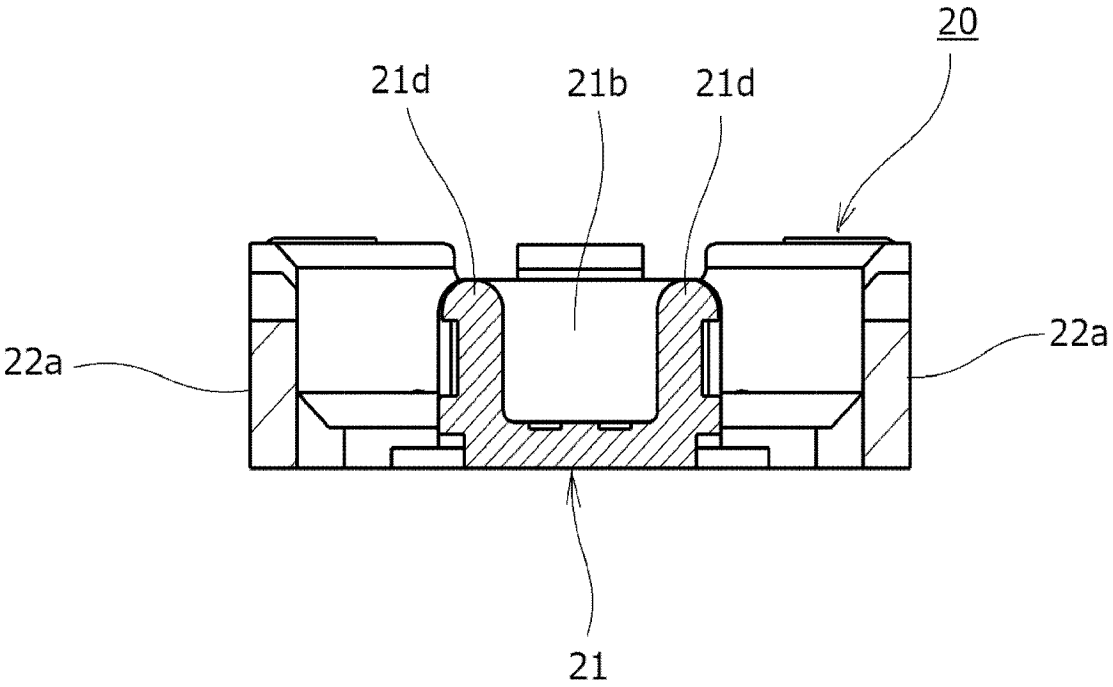
FIG. 16 is an enlarged transverse sectional explanatory diagram along a line XVI-XVI in FIG. 12.

More specifically, the central recess 21*b* in the second housing 21 to which the second contact members 23 are attached is formed such that a portion between the above-described two electrode arrays, i.e., a portion between the longitudinal sidewall sections 21*d* and 21*d* on both sides forms a concave-shaped space extending in the connector longitudinal direction while the second contact members 23 are respectively attached to surround the longitudinal sidewall sections 21*d* from the outer periphery in cross section, as particularly illustrated in FIG. 15 and FIG. 16. The paired second contact members 23 and 23 respectively constituting the electrode arrays on both sides are arranged to oppose each other to have a symmetrical shape in the connector width direction.

In each of the second contact members 23, a site protruding upward to have an inverted U shape in cross section is a fitting protrusion 23*a*. The fitting protrusion 23*a* is configured to be inserted from above into the fitting recess 13*a* provided in the first contact member 13 in the receptacle connector (first connector) 10 as a mating fitting body and received in the fitting recess 13*a* when the first contact member 13 is elastically displaced.

Although the fitting protrusion 23*a* having an inverted U shape in the above-described second contact member 23 includes an inner wall surface nearer the connector center and an outer wall surface nearer the connector outer side that extend substantially parallel to each other in the up-and-down direction, an inner contact section 23*b* and an outer contact section 23*c* are each formed to have a concave shape, for example, respectively, on wall surfaces on the connector inner side and the connector outer side. When both the electrical connectors 10 and 20 are fitted into each other, and the fitting protrusion 23*a* in the second contact member 23 provided in the plug connector (second connector) 20 is inserted into the inner space of the fitting recess 13*a* in the first contact member 13 provided in the above-described receptacle connector (first connector) 10, the inner contact section 23*b* and the outer contact section 23*c* in the plug connector 20 are electrically connected to each other by elastically contacting the inner contact section 13*e* and the outer contact section 13*f* in the above-described receptacle connector 10 so that signal transmission is performed.

Figure 26:
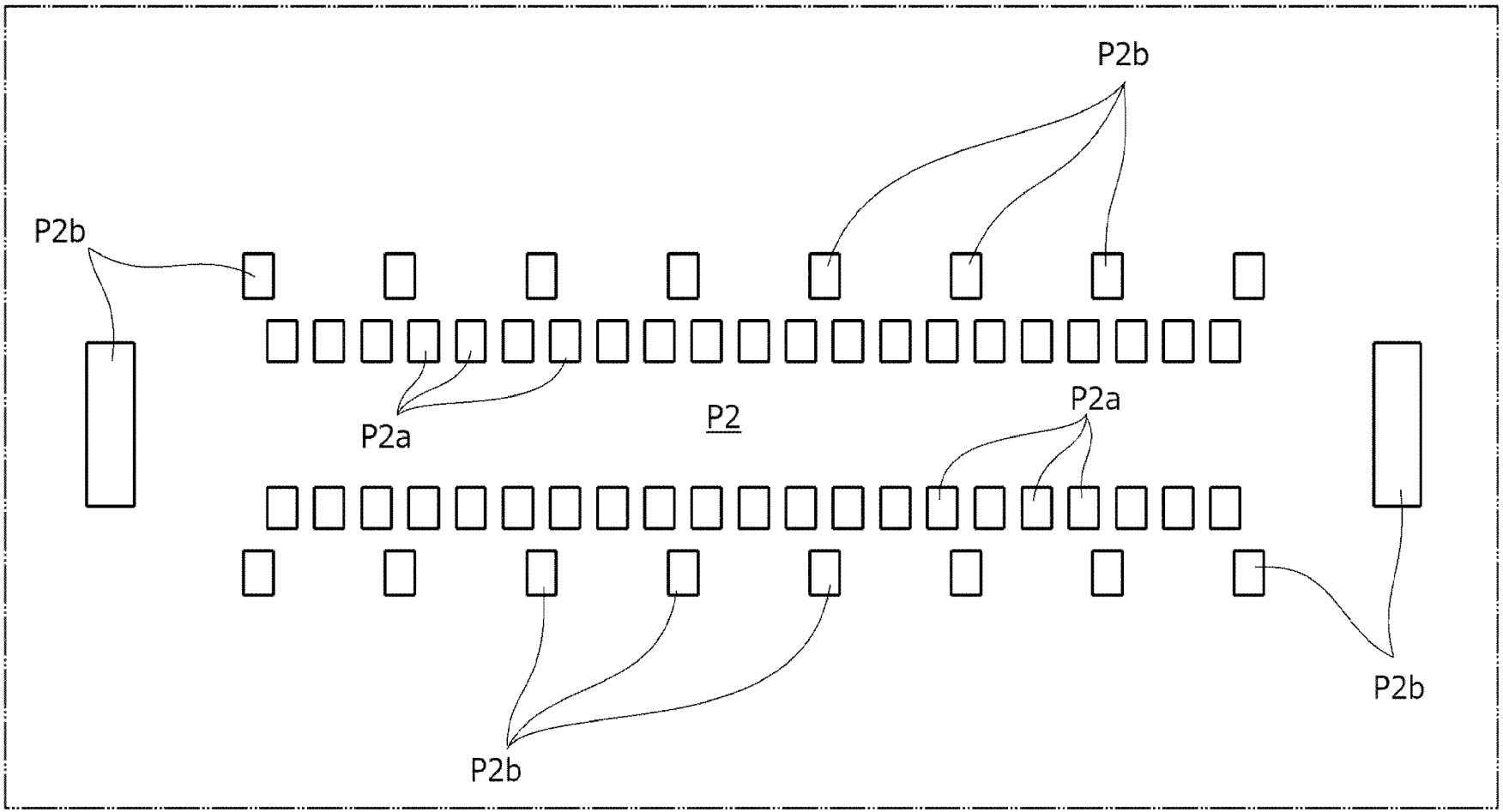
FIG. 26 is an appearance perspective explanatory diagram illustrating an example of a structure of a wiring substrate on which the second connector (plug connector) is mounted.

An inner wall portion of the fitting protrusion 23*a* in the second contact member 23 extends downward, and is brought into a state embedded in a bottom surface portion of the second housing 21. An embedded portion of the second contact member 23 is bent to extend at a substantially right angle outward in the connector width direction at a lower surface position of the plug connector 20, and its horizontally extending portion is a second contact connection section (signal connection section) 23*d*. The second contact connection section 23*d* is solder-bonded to a conductive path for signal transmission (signal pad) P2*a* on the second wiring substrate P2 as illustrated in FIG. 26 when the plug connector 20 is mounted on the second wiring substrate P2. The solder bonding of the second contact connection section 23*d* is integrally performed for all the second contact connection sections 23*d* using a longitudinal solder material.

[As to Shield Shell in Receptacle Connector]

Then, the first shield shell 12 provided as a shield wall section in the receptacle connector (first connector) 10 is formed of two frame-shaped structures obtained by division, as particularly illustrated in FIG. 9, and the two frame-shaped structures are mounted on the first housing 11 in a state where they are oppositely arranged to symmetrically face each other in the connector width direction. Each of the pair of first shield shells 12 and 12 as the frame-shaped structures is formed of a bending member made of a thin plate-shaped metal having a substantially ⊐ shape in a planar view. A longitudinal sidewall plate 12*a* forming a longer side portion in a planar, substantially ⊐ shape in each of the first shield shells 12 is arranged to extend in the connector longitudinal direction while a lateral sidewall plate 12*b* forming a shorter side portion in a planar, substantially ⊐ shape is arranged to extend in the connector width direction. When the longitudinal sidewall plates 12*a* and 12*a* and the lateral sidewall plates 12*b* and 12*b* respectively constituting the pair of first shield shells 12 and 12 are arranged with they opposing each other substantially parallel to each other, and are brought into such an opposing arrangement relationship, a frame structure an entire shape in a planer view of which has a substantially rectangular shape is configured.

Four corner portions as connection portions among the longitudinal sidewall plates 12*a* and the lateral sidewall plates 12*b* in the first shield shells 12 are respectively provided with fixed locking pieces 12*c* to the first housing 11. Although each of the fixed locking pieces 12*c* extends to stretch toward the connector center (inward) from respective upper edge portions of the longitudinal sidewall plate 12*a* and the lateral sidewall plate 12*b*, the fixed locking piece 12*c* extending from the lateral sidewall plate 12*b* has a curved shape bent to extend in an inverted U shape downward from a portion stretching toward the connector center (inward). When the fixed locking piece 12*c* extending from the lateral sidewall plate 12*b* is press-fitted from above into the proximal end section 11*a* in the above-described first housing 11, the entire shield shell 12 is brought into a fixed state to the first housing 11.

Thus, the first shield shell 12 composed of the frame structure having a planar, substantially rectangular shape is configured to surround the outer periphery of the first housing 11 over its entire circumference so that electromagnetic shielding for the first contact member 13 attached to the first housing 11 is performed.

Particularly, the longitudinal sidewall plate 12*a* in the first shield shell 12 is brought into an arrangement relationship vertically provided at a position with predetermined spacing in the connector width direction from the first contact connection section (signal connection section) 13*g* in the above-described first contact member 13, and the longitudinal sidewall plate 12*a* in the first shield shell 12 extends in the connector longitudinal direction (the arrangement direction of the first contact member 13) while opposing an outer end surface of the first contact connection section 13*g* in the first contact member 13. As a result, electromagnetic shielding for the entire first contact member 13 including the first contact connection section 13*g* is favorably performed with impedance matching appropriately performed via a space portion between the above-described first contact connection section 13*g* and the longitudinal sidewall plate 12*a* in the first shield shell 12.

Figure 6:
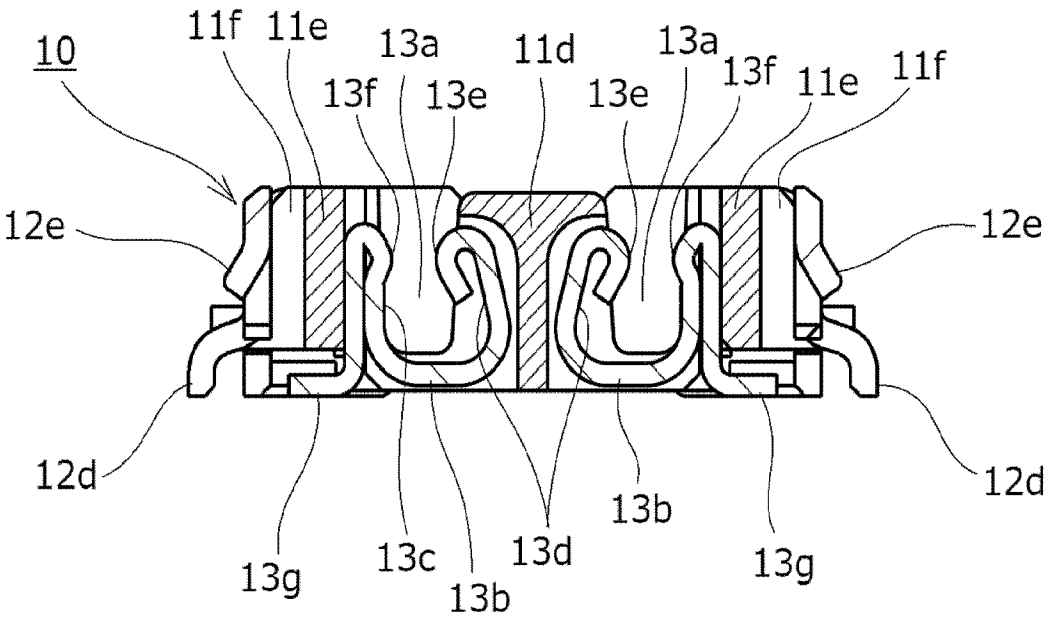
FIG. 6 is an enlarged transverse sectional explanatory diagram along a line VI-VI illustrated in FIG. 4.

Further, the longitudinal sidewall section 11*e* in the above-described first housing 11 is arranged in a state separated from the longitudinal sidewall plate 12*a* in the first shield shell 12 with a gap section 11*f* forming predetermined spacing interposed therebetween inward in the connector width direction (toward the connector center), as particularly illustrated in FIG. 6 and FIG. 8. The gap section 11*f* is arranged in a portion excluding both ends in the connector longitudinal direction of an outer end surface of the longitudinal sidewall section 11*e* in the first housing 11, i.e., a range opposing the above-described first contact member 13 in the connector longitudinal direction. When the gap section 11*f* is provided, the outer end surface of the longitudinal sidewall section 11*e* in the first housing 11 is separated from the longitudinal sidewall plate 12*a* in the first shield shell 12 inward in the connector width direction.

If the gap section 11*f* is provided, a connected state of the first contact member 13, for example, can be observed from above via the gap section 11*f*. When the size of the gap section 11*f* is adjusted, an impedance characteristic based on the gap section 11*f* is adjusted to an appropriate state.

The present invention is also directed to providing an electrical connector device for substrate connection that can favorably obtain a shield function and an impedance characteristic by a shield shell.

[As to First Substrate Connection Section]

Figure 7:
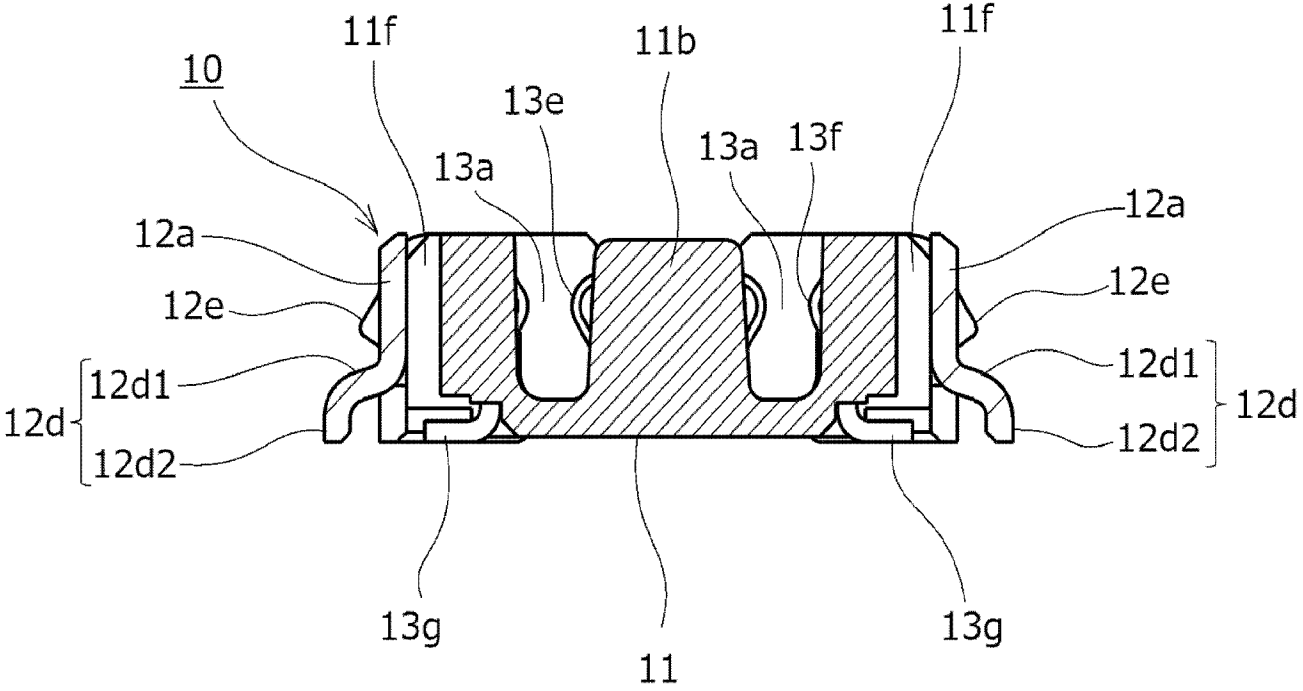
FIG. 7 is an enlarged transverse sectional explanatory diagram along a line VII-VII illustrated in FIG. 4.

On the other hand, as particularly illustrated in FIG. 7, a first substrate connection section (ground connection section) 12*d* composed of a plate-shaped protrusion piece protruding toward the main surface of the lower first wiring substrate P1 is integrally formed in a lower edge portion of the longitudinal sidewall plate 12*a* in the first shield shell 12. Although the first substrate connection section 12*d* includes a plurality of first substrate connection sections 12*d* provided in the connector longitudinal direction, each of the first substrate connection sections 12*d* arranged in the connector longitudinal direction is arranged between the first contact members 13 and 13 adjacent to each other in the same connector longitudinal direction, as particularly illustrated in FIG. 4.

The plate-shaped protrusion piece forming each of the first substrate connection sections (ground connection sections) 12*d* is formed to stretch outward in the connector width direction from a lower edge portion of the longitudinal sidewall plate 12*a* constituting a part of the first shield shell 12, and aside surface shape as viewed in the connector longitudinal direction is a crank shape. That is, as particularly illustrated in FIGS. 7 and 24, the first substrate connection section 12*d* includes a step section 12*d*1 stretching outward in the connector width direction from an outer end surface in the connector width direction of the above-described first shield shell 12 while being configured such that a connection piece section 12*d*2 protrudes toward the main surface of the lower first wiring substrate P1.

The connection piece section 12*d*2 forming a lower end portion of the first substrate connection section (ground connection section) 12*d* is electrically connected by solder bonding to a conductive path for grounding (ground pad) P1*b* formed on the main surface of the first wiring substrate P1. The solder bonding of the first substrate connection section 12*d* in the case can be integrally performed for all the first substrate connection sections 12*d* using a longitudinal solder material.

Figure 24:
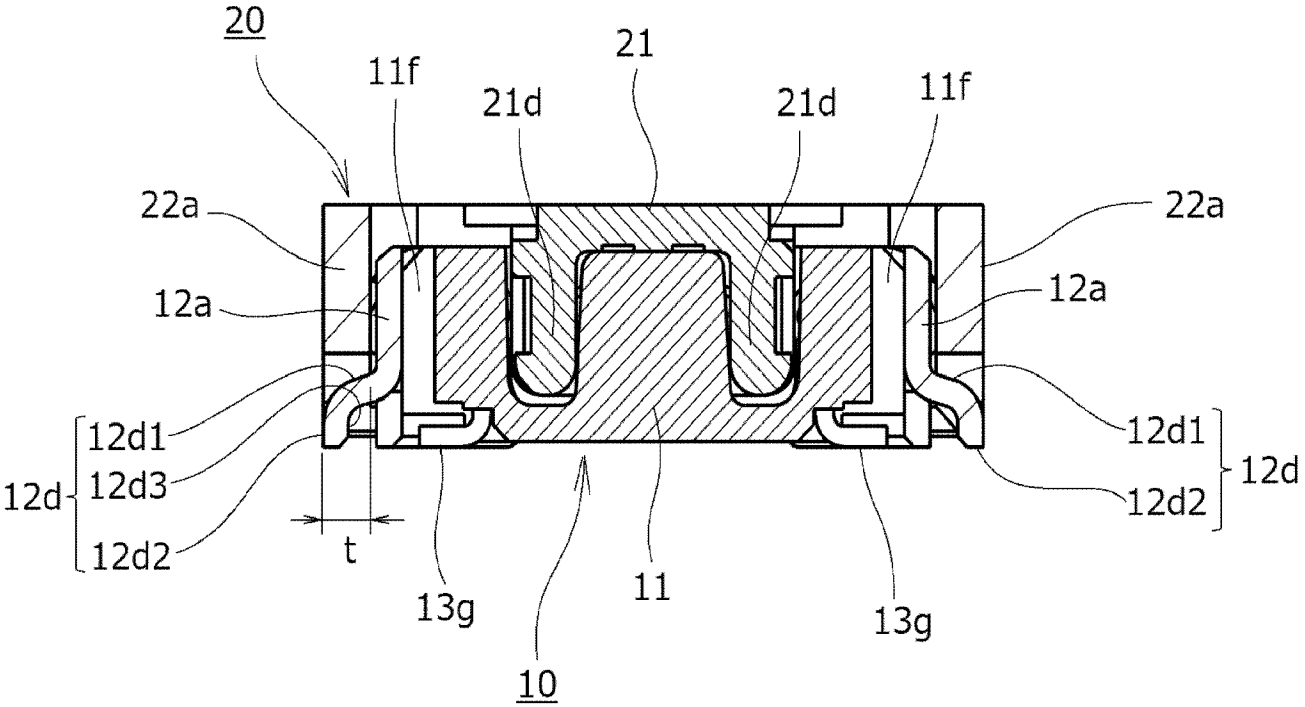
FIG. 24 is an enlarged transverse sectional explanatory diagram also illustrating a wiring substrate along a line XXIV-XXIV in FIG. 21.

Although the connection piece section 12*d*2 in the above-described first substrate connection section (ground connection section) 12*d* includes an inner end surface 12*d*3 inside in the connector width direction (plate thickness direction), as particularly illustrated in FIG. 24, the inner end surface 12*d*3 in the connection piece section 12*d*2 is configured to be arranged within a range of a plate width t in the connector width direction of the second shield shell 22 when the plug connector (second connector) 20 is fitted into the receptacle connector (first connector) 10. Therefore, the longitudinal sidewall plate 12*a* in the first shield shell 12 is positioned inside in the connector width direction of the connection piece section 12*d*2 over steps in the connector width direction included in the step section 12*d*1 in the above-described first substrate connection section 12*d*, and the second shield shell arranged outside the first shield shell 12 when both the electrical connectors 10 and 20 are fitted into each other is arranged more inside in the connector width direction than in the conventional example by an amount in which the first shield shell 12 is thus positioned inside in the connector width direction. As a result, a width dimension of the entire electrical connector device is reduced in the connector width direction.

The first shield shell 12 is brought into a state separated upward from the main surface of the first wiring substrate P1 by a height of the connection piece section 12*d*2 in the above-described first substrate connection section (ground connection section) 12*d*. Therefore, a space for performing electrical connection to the first wiring substrate P1 is formed in a portion below the first shield shell 12, and the first shield shell 12 remains not easily interfering with the conductive path for signal transmission (signal pad) P1*a* to which the first contact member 13 arranged inside in the connector width direction of the first shield shell 12 is connected. As a result, the first shield shell 12 can be brought closer to the conductive path for signal transmission (signal pad) P1*a*. When the conductive path for grounding (ground pad) P1*b* to which the first shield shell 12 is connected is brought closer in the connector width direction to the conductive path for signal transmission (signal pad) P1*a* to which the first contact member 13 is connected, the entire electrical connector device can be further miniaturized.

On the other hand, a leaf spring piece 12*e* stretching in the connector width direction is provided to be cut and raised in the longitudinal sidewall plate 12*a* in the above-described first shield shell 12. The leaf spring piece 12*e* includes a plurality of leaf spring pieces provided with predetermined spacing in the connector longitudinal direction, and a distal end portion of the leaf spring piece 12*e* is formed to obliquely stretch outward in the connector width direction from an outer surface of the first shield shell 12.

When the plug connector (second connector) 20 is fitted from above into the receptacle connector (first connector) 10, the distal end portion of the above-described leaf spring piece 12*e* is brought into an arrangement relationship elastically contacting the second shield shell 22 in the plug connector 20 from inside.

Further, a portion between both ends in an extension direction of the first shield shell 12 (the connector longitudinal direction) is provided with a plurality of (a pair of) engagement pieces 12*f* to be fixed to a part of the first housing 11. That is, a plurality of (a pair of) locking sections 11*g* are provided to protrude outward in the connector width direction at positions respectively corresponding to the engagement pieces 12*f* in the above-described first shield shell 12 in a halfway portion in the connector longitudinal direction of the longitudinal sidewall plate 12*a* in the first housing 11. Each of the locking sections 11*g* has a locking hole that penetrates therethrough formed in the up-and-down direction. The engagement piece 12*f* provided in the first shield shell 12 is press-fitted from above into the locking hole provided in each of the locking sections 11*g* in the first housing 11.

In such a configuration, the entire first shield shell 12 is maintained in a rigid fixed state in the first housing 11 via the locking piece 12*f*, and possibilities of deflection and deformation of the first shield shell 12 are avoided. Accordingly, the size of the gap section 11*f* can be kept constant so that a favorable shield function (electromagnetic shielding) and impedance characteristic are obtained.

[As to Shield Shell in Plug Connector]

On the other hand, as particularly illustrated in FIG. 17, the shield shell 22 provided as a shield wall section in the plug connector (second connector) 20 is also formed of two frame-shaped structures obtained by division, and the two frame-shaped structures are mounted on the second housing 21 in a state where they are oppositely arranged to symmetrically face each other in the connector width direction. Each of the pair of second shield shells 22 and 22 is formed of a bending member made of a thin plate-shaped metal having a substantially ⊐ shape in a planar view, and a longitudinal sidewall plate 22*a* forming a longer side portion in a planar, substantially ⊐ shape in each of the second shield shells 22 is arranged to extend in the connector longitudinal direction.

Fixed locking pieces 22*b* and 22*b* as lateral sidewall plates each bent at a substantially right angle toward the other shield shell 22 are integrally consecutively provided, respectively, in both end portions in the connector longitudinal direction of the above-described longitudinal sidewall plate 22*a*. The fixed locking pieces (lateral sidewall plates) 22*b* and 22*b* in each of the second shield shells 22 extend in the connector width direction, and are attached by press-fitting or insert-molding to respective inner parts of the proximal end sections 21*a* and 21*a* forming an edge portion in the connector longitudinal direction of the first housing 11. As a result, the entire shield shell 22 remains fixed to the second housing 21.

The longitudinal sidewall plates 22*a* and 22*a* constituting the above-described pair of second shield shells 22 and 22 are arranged in a state where they oppose each other substantially parallel to each other while the fixed locking pieces 22*b* and 22*b* as the lateral sidewall plates are arranged to abut on each other in the connector width direction. Therefore, a frame structure an entire shape in a planar view of which has a substantially rectangular shape is configured.

Thus, in the plug connector (second connector) 20 according to the present embodiment, the fixed locking pieces (lateral sidewall plates) 22*b* provided in both end portions of the longitudinal sidewall plate 22*a* in the second shield shell 22 are respectively brought into a state where they are inserted (embedded) into the proximal end sections 21*a* in the first housing 11. Accordingly, the second shield shell 22 remains housed within a range of an entire length in the connector longitudinal direction of the second housing 21. The second shield shell 22 does not stretch toward the outside of the second housing 21 so that the entire connector is miniaturized in the connector longitudinal direction. In addition, in the present embodiment, a second substrate connection section (ground connection section) 22*c* in the second shield shell 22 is arranged in a state housed within a range of a plate thickness of a plate-shaped member forming the second shield shell 22, and therefore does not stretch toward the outside of the second shield shell 22 so that the entire connector can also be further miniaturized in the connector width direction.

The pair of first shield shells 12 and 12 and the pair of second shield shells 22 and 22 each having a planar, substantially ⊐ shape are arranged to oppose each other in the connector width direction to constitute frame structures, respectively, in the receptacle connector (first connector) 10 and the plug connector (second connector) 20, as described above. However, when both the electrical connectors 10 and 20 are brought into a fitted state, as illustrated in FIG. 18 to FIG. 24, the second shield shell 22 provided in the plug connector 20 is arranged outside the first shield shell 12 provided in the receptacle connector 10, and the longitudinal sidewall plate 22*a* in the second shield shell 22 is arranged at a position outside in the connector width direction of the longitudinal sidewall plate 12*a* in the first shield shell 12 in the connector width direction.

More specifically, an inner end surface in the connector width direction of the longitudinal sidewall plate 22*a* in the second shield shell 22 is brought into a relationship opposing and overlapping in the connector width direction an outer end surface in the connector width direction of the longitudinal sidewall plate 12*a* in the first shield shell 12 while an inner end surface in the connector longitudinal direction of the fixed locking piece 22*b* as the lateral sidewall plate in the second shield shell 22 is brought into a relationship opposing and overlapping in the connector longitudinal direction an outer position of an outer end surface in the connector longitudinal direction of the lateral sidewall plate 12*b* in the first shield shell 12. As a result, the entire periphery of the electrical connector device remains completely covered with the shield wall section so that a significantly favorable shielding function is obtained.

The second substrate connection section (ground connection section) 22*c* composed of a plate-shaped protrusion piece protruding downward toward the surface of the second wiring substrate P2 includes a plurality of second substrate connection sections 22*c* formed in a lower edge portion of the longitudinal sidewall plate 22*a* and the fixed locking piece (lateral sidewall plate) 22*b* in the second shield shell 22. The plate-shaped protrusion piece forming each of the second substrate connection sections 22*c* is formed to connect with the longitudinal sidewall plate 22*a* and the fixed locking piece (lateral sidewall plate) 22*b* to have a surface flush therewith, and extends within a range of the plate thickness of the plate-shaped member forming the longitudinal sidewall plate 22*a* and the fixed locking piece (lateral sidewall plate) 22*b*.

Although a lower end of the above-described second substrate connection section (ground connection section) 22*c* is electrically connected by solder bonding to a conductive path for grounding (ground pad) P2*b* provided on the main surface of the second wiring substrate P2 illustrated in FIG. 26, the solder bonding of the second substrate connection section 22*c* in the case is performed integrally with all the second substrate connection sections 22*c* using a longitudinal solder material.

The longitudinal sidewall plate 22*a* in the second shield shell 22 in the present embodiment is brought into an arrangement relationship vertically provided on the surface of the second wiring substrate P2 at a position with predetermined spacing in the connector width direction from the second contact connection section (signal connection section) 23*d* in the above-described second contact member 23. That is, when the longitudinal sidewall plate 22*a* in the second shield shell 22 extends in the connector longitudinal direction (the arrangement direction of the second contact member 23) while opposing in the connector longitudinal direction an outer end surface of the second contact connection section 23*d* in the second contact member 23, electromagnetic shielding for the entire second contact member 23 including the second contact connection sections 23*d* is favorably performed in an appropriately impedance-matched state via a space portion between the above-described second contact connection section 23*d* and the longitudinal sidewall plate 22*a* in the second shield shell 22.

As described above, in the present embodiment, in the receptacle connector (first connector) 10 and the plug connector (second connector) 20, electromagnetic shielding functions for the first contact connection section (signal connection section) 13*g* and the second contact connection section (signal connection section) 23*d* are respectively obtained by the first shield shell 12 and the second shield shell 22 provided as their respective shield wall sections. When both the electrical connectors 10 and 20 are fitted into each other, the first shield shell 12 and the second shield shell 22 are doubly arranged inside and outside, and a gap formed between one of the first shield shell 12 and the second shield shell 22 and one of both the wiring substrates P1 and P2 is partially covered with the other of the first shield shell 12 and the second shield shell 22. Accordingly, a significantly favorable electromagnetic shielding function is obtained as an electrical connector device. Particularly, respective gaps between the first shield shell 12 and the second shield shell 22 and each of the first and second wiring substrates P1 and P2 can be efficiently closed. Accordingly, a sufficient EMI countermeasure can be expected.

In addition, in the present embodiment, when the receptacle connector (first connector) 10 and the plug connector (second connector) 20 are fitted into each other, the longitudinal sidewall plate 22*a* in the second shield shell 22 is arranged at a position above the first substrate connection section (ground connection section) 12*d* provided in the first shield shell 12, as particularly illustrated in FIG. 24. That is, a fitting position in the connector width direction of the longitudinal sidewall plate 22*a* in the second shield shell 22 overlaps in the connector width direction the first substrate connection section 12*d* in the first shield shell 12. As a result, the longitudinal sidewall plate 22*a* in the second shield shell 12 is arranged at a position more inward in the connector width direction than the first substrate connection section 12*d* in the first shield shell 12 and the conductive path for grounding (ground pad) P1*b* to which the first substrate connection section 12*d* is connected.

That is, the longitudinal sidewall plate 12*a* in the first shield shell 12 is arranged more inward in the connector width direction than the first substrate connection section 12*d*. Accordingly, when both the connectors 10 and 20 are fitted into each other, the second shield shell 22 arranged outside the first shield shell 12 is arranged more inside the connector than in the conventional example. Therefore, even when the conductive path for grounding (ground pad) P1*b* is separated at an outer position in the connector width direction from the conductive path for signal transmission (signal pad) P1*a*, the longitudinal sidewall plate 22*a* in the second shield shell 22 is brought inward in the connector width direction, as described above. Accordingly, the entire electrical connector device is narrowed in the connector width direction and is miniaturized.

Further, in the present embodiment, in the first substrate connection section (ground connection section) 12*d* provided in the first shield shell 12, the connection piece section 12*d*2 protrudes downward from the step section 12*d*1 stretching outward in the same direction from the outer end surface in the connector width direction of the first shield shell 12. The entire first shield shell 12 is maintained in a state separated from the main surface of the first wiring substrate P1 by an amount in which the connection piece section 12*d*2 protrudes toward the main surface of the first wiring substrate P1. Therefore, the first shield shell 12 in the present embodiment remains not easily interfering with the first contact connection section (signal connection section) 13*g* provided in the first contact member 13 and the conductive path for signal transmission (signal pad) P1*a* to which the first contact member 13 is connected.

Thus, according to the present embodiment in which a space portion for avoiding the interference with the first contact connection section (signal connection section) 13*g* is provided below the first shield shell 12, the first shield shell 12 can be brought closer to the conductive path for signal transmission (signal pad) P1*a* than when the first shield shell 12 easily interferes with the first contact connection section 13*g* in close proximity to the main surface of the first wiring substrate P1. When the conductive path for grounding (ground pad) P1*b* to which the first shield shell 12 is connected is brought closer to the conductive path for signal transmission (signal pad) P1*a* to which the first contact member 13 is connected in the connector width direction, the entire electrical connector device can be further miniaturized.

In the second shield shell 22 provided in the plug connector (second connector) 20 in the present embodiment, when both the electrical connectors 10 and 20 are fitted into each other, an inner wall surface (inner end surface) of the longitudinal sidewall plate 22*a* in the second shield shell 22 elastically contacts a distal end portion of the leaf spring piece 12*e* provided in the first shield shell 12 in the receptacle connector (first connector) 10 from outside. As a result, the first shield shell 12 and the second shield shell 22 are brought into an electrically connected state, and a part of a ground circuit is configured via the leaf spring piece 12*e*. Accordingly, electrical conductivity is improved by a contact area of the leaf spring piece 12*e* so that a ground resistance is reduced, and a shield characteristic is improved.

Although the invention made by the inventors of the present invention has been specifically described based on the embodiment, it is to be understood that the embodiment is not limited to the above-described embodiment, but can be deformed in various manners without departing from the scope of the invention.

Although in the above-described embodiment, the first substrate connection section (ground connection section) 12*d* provided in the first shield shell 12 is configured to have a substantially crank side surface shape including the connection piece section 12*d*2 via the step section 12*d*1 stretching outward in the connector width direction, for example, the first substrate connection section 12*d* can also be configured to have a substantially L side surface shape in which the lower edge portion of the first shield shell 12 is extended to a state brought closer to a surface of the wiring substrate without via the step section and the first substrate connection section (ground connection section) is extended substantially horizontally outward in the connector width direction by suppressing an amount of protrusion from an outer end surface of the longitudinal sidewall plate 22*a* directly from the lower edge portion of the first shield shell 12.

Each of the contact members 12 and 22 in the above-described embodiment may be naturally configured as a single electrode array (one electrode array), although configured as two electrode arrays symmetrically opposing each other.

INDUSTRIAL APPLICABILITY

As described above, the present invention is widely applicable to a wide variety of electrical connector devices for substrate connection used for various types of electronic/electrical equipment.

REFERENCE SIGNS LIST

10 receptacle connector (first connector)
11 first housing
- 11*a* proximal end section
- 11*b* central protrusion
- 11*c* contact mounting groove
- 11*d* partition plate
- 11*e* longitudinal sidewall section
- 11*f* gap section
- 11*g* locking section
- 11*g* first shield shell (shield wall section)

12*a* longitudinal sidewall plate
- 12*b* lateral sidewall plate
- 12*c* fixed locking piece
- 12*d* first substrate connection section (ground connection section)
- 12*d*1 step section
- 12*d*2 connection piece section
- 12*d*3 inner end surface
- 12*e* leaf spring piece
- 12*f* locking piece

13 first contact member
- 13*a* fitting recess
- 13*b* bottom surface section
- 13*c* outward rising side section
- 13*d* inward rising side section
- 13*e* inner contact section
- 13*f* outer contact section
- 13*g* first contact connection section (signal connection section)

20 plug connector (second connector)
21 second housing
- 21*a* proximal end section
- 21*b* central recess
- 21*d* longitudinal sidewall section

22 second shield shell (shield wall section)
- 22*a* longitudinal sidewall plate
- 22*b* fixed locking piece (lateral sidewall plate)
- 22*c* second substrate connection section (ground connection section)

23 second contact member
- 23*a* fitting protrusion
- 23*b* inner contact section
- 23*c* outer contact section
- 23*d* second contact connection section (signal connection section)

P1 first wiring substrate
- P1*a* conductive path for signal transmission (signal pad)
- P1*b* conductive path for grounding (ground pad)

P2 second wiring substrate
- P2*a* conductive path for signal transmission (signal pad)
- P2*b* conductive path for grounding (ground pad)

The invention claimed is:

1. An electrical connector device for substrate connection, comprising:

a first connector and a second connector that are brought into a fitted state with the first connector and the second connector being respectively mounted on main surfaces of first and second wiring substrates, at least one first contact member and at least one second contact member each composed of a conductive member for signal connection and first and second shield shells with conductivity, each shell having a predetermined plate width in a connector width direction at positions outside the connector width direction of the at least one first contact member and the at least one second contact member that are respectively attached to first and second housings having an insulating property provided in the first and second connectors, first and second substrate connection sections provided in the first and second shield shells being respectively electrically connected to first and second conductive paths for grounding provided in the first and second wiring substrates, and an outer end surface in the connector width direction of the first shield shell and an inner end surface in the connector width direction of the second shield shell being in an overlapping relationship by opposing each other in the connector width direction when the first connector and the second connector are fitted into each other, wherein the first substrate connection section protrudes outward in the connector width direction from the outer end surface of the first shield shell, and an inner end surface in the connector width direction of the first substrate connection section is arranged within a range of the predetermined plate width of the second shield shell in the connector width direction when the first connector and the second connector are fitted into each other.

2. The electrical connector device for substrate connection according to claim 1, wherein the first substrate connection section includes a step section stretching outward in the connector width direction from the outer end surface of the first shield shell, and a connection piece section protruding toward the main surface of the first wiring substrate from the step section.

3. The electrical connector device for substrate connection according to claim 1, wherein the first substrate connection section is separated outward in the connector width direction from an outer end surface in the connector width direction of the first housing.

4. The electrical connector device for substrate connection according to claim 1, wherein the first housing includes a gap section that separates the outer end surface in the connector width direction inward in the connector width direction from the first shield shell in a site opposing the first contact member in the connector width direction.

5. The electrical connector device for substrate connection according to claim 1, wherein the at least one first contact member and the at least one second contact member respectively include a plurality of first contact members and a plurality of second contact members arranged with predetermined spacing in a connector longitudinal direction perpendicular to the connector width direction, and the first substrate connection section is arranged between de-adjacent first contact members in the connector longitudinal direction.

6. The electrical connector device for substrate connection according to claim 1, wherein the first and second contact members are respectively electrically connected to first and second conductive paths for signal transmission provided in the first and second wiring substrates, at least respective parts of the first and second conductive paths for signal transmission are arranged in a state where they respectively oppose the first and second conductive paths for grounding in the connector width direction.

7. The electrical connector device for substrate connection according to claim 1, wherein the first shield shell is provided with a leaf spring piece elastically contacting the second shield shell when the first connector and the second connector are fitted into each other.

8. The electrical connector device for substrate connection according to claim 1, wherein the first shield shell extends in a connector longitudinal direction perpendicular to the connector width direction, and an engagement piece fixed to a part of the first housing is provided in a portion between both ends in an extension direction of the first shield shell.

* * * * *